US011524514B2

(12) United States Patent
Bollstrom et al.

(10) Patent No.: US 11,524,514 B2
(45) Date of Patent: Dec. 13, 2022

(54) TAMPER-PROOF MEDIUM FOR THERMAL PRINTING

(71) Applicant: OMYA INTERNATIONAL AG, Oftringen (CH)

(72) Inventors: Roger Bollstrom, Zofingen (CH); Gilbert Botty, Maastricht (NL); Philipp Hunziker, Loveland, OH (US)

(73) Assignee: OMYA INTERNATIONAL AG, Oftringen (CH)

( * ) Notice: Subject to any disclaimer, the term of this patent is extended or adjusted under 35 U.S.C. 154(b) by 304 days.

(21) Appl. No.: 16/622,342

(22) PCT Filed: Jun. 12, 2018

(86) PCT No.: PCT/EP2018/065531
§ 371 (c)(1),
(2) Date: Dec. 13, 2019

(87) PCT Pub. No.: WO2018/234106
PCT Pub. Date: Dec. 27, 2018

(65) Prior Publication Data

US 2020/0198386 A1 Jun. 25, 2020

Related U.S. Application Data

(60) Provisional application No. 62/526,424, filed on Jun. 29, 2017.

(30) Foreign Application Priority Data

Jun. 22, 2017 (EP) ..... 17177495

(51) Int. Cl.
*B41M 3/14* (2006.01)
*B41M 1/30* (2006.01)
(Continued)

(52) U.S. Cl.
CPC ..... *B41M 3/142* (2013.01); *B41M 1/30* (2013.01); *B41M 1/36* (2013.01); *B41M 3/001* (2013.01);
(Continued)

(58) Field of Classification Search
CPC ..... B41M 1/36; B41M 3/001; B41M 3/142; B41M 5/3338
See application file for complete search history.

(56) References Cited

U.S. PATENT DOCUMENTS 4,570,169 A 2/1986 Kasamatsu et al.
5,465,301 A * 11/1995 Jotcham ..... D21H 21/42 380/54
(Continued)

FOREIGN PATENT DOCUMENTS

CN 101910330 A * 12/2010 ..... C09D 11/17
CN 106366704 A 2/2017
(Continued)

OTHER PUBLICATIONS

International Search Report from PCT/EP2018/065531, dated Sep. 11, 2018, 3 pages.
(Continued)

*Primary Examiner* — Matthew G Marini
*Assistant Examiner* — Marissa Ferguson-Samreth
(74) *Attorney, Agent, or Firm* — ALGM LLP; Harry J. Guttman

(57) ABSTRACT

The present invention relates to method of manufacturing a tamper-proof medium for thermal printing, wherein a liquid treatment composition comprising at least one acid is deposited on a substrate which comprises a thermochromic coating layer comprising at least one halochromic leuco dye.

24 Claims, 4 Drawing Sheets

(51) Int. Cl.

| | |
|---|---|
| ***B41M 1/36*** | (2006.01) |
| ***B41M 3/00*** | (2006.01) |
| ***B41M 5/323*** | (2006.01) |
| ***B41M 5/333*** | (2006.01) |

(52) U.S. Cl.
CPC ..... *B41M 5/323* (2013.01); *B41M 5/3335* (2013.01); *B41M 5/3338* (2013.01); *B41M 2205/04* (2013.01)

(56) References Cited

U.S. PATENT DOCUMENTS

| | | | | |
|---|---|---|---|---|
| 6,060,426 | A | 5/2000 | Tan et al. | |
| 6,245,711 | B1 * | 6/2001 | Halbrook, Jr. | B41M 3/14 427/152 |
| 7,645,719 | B2 * | 1/2010 | Wehr | B41M 3/144 503/209 |
| 9,789,721 | B2 * | 10/2017 | Takano | B41M 5/323 |
| 2005/0064151 | A1 * | 3/2005 | Mehta | B42D 25/21 428/195.1 |
| 2012/0031576 | A1 | 2/2012 | Gane et al. | |

FOREIGN PATENT DOCUMENTS

| | | | | |
|---|---|---|---|---|
| EP | 0968837 | A1 | 1/2000 | |
| EP | 1712523 | A1 | 10/2006 | |
| EP | 1712597 | A1 | 10/2006 | |
| EP | 1448397 | B1 | 7/2007 | |
| EP | 1900542 | A1 | 3/2008 | |
| EP | 2159258 | A1 | 3/2010 | |
| EP | 2264108 | A1 | 12/2010 | |
| EP | 2371766 | A1 | 10/2011 | |
| EP | 2264109 | B1 | 1/2012 | |
| EP | 2447213 | A1 | 5/2012 | |
| EP | 2524898 | A1 | 11/2012 | |
| EP | 2722368 | A1 | 4/2014 | |
| EP | 2770017 | A1 | 8/2014 | |
| EP | 3067214 | A1 | 9/2016 | |
| EP | 3173247 | A1 | 5/2017 | |
| EP | 3173522 | A1 | 5/2017 | |
| EP | 3293010 | A1 | 3/2018 | |
| EP | 3293322 | A1 | 3/2018 | |
| GB | 1507454 | A | 4/1978 | |
| WO | 99/19150 | A1 | 4/1999 | |
| WO | 00/39222 | A1 | 7/2000 | |
| WO | 2005/121257 | A2 | 12/2005 | |
| WO | 2009/074492 | A1 | 6/2009 | |
| WO | 2013/142473 | A1 | 9/2013 | |
| WO | 2015/181056 | A9 | 12/2015 | |
| WO | WO-2016146458 | A1 * | 9/2016 | C09D 11/50 |

OTHER PUBLICATIONS

Written Opinion from PCT/EP2018/065531, dated Sep. 11, 2018, 5 pages.

CN Patent No. 106366704 (Feb. 1, 2017)—English-language abstract from Espacenet, 1 page.

* cited by examiner

TAMPER-PROOF MEDIUM FOR THERMAL PRINTING

The present invention relates to a method of manufacturing a tamper-proof medium for thermal printing, a tamper-proof medium obtainable by said method and its use.

With the improvements in desktop publishing and colour-photocopiers, the opportunities for document fraud have increased dramatically. Moreover, the quality of forgeries is constantly improving and spans a wide variety of industries.

In the travel and entertainment sector, for example, a continuously rising number of frauds is registered concerning parking tickets, public transport tickets, airline tickets, or event tickets such as soccer, concert or museum tickets. These tickets are frequently produced by thermal printing, i.e. a digital printing process which produces a printed image by selectively heating so-called thermochromic or thermal paper, when the paper passes over a thermal print head. Thermal paper is a special fine paper that is coated with a thermochromic coating layer comprising a leuco dye and a colour developing agent, for example, an acid. When the coating is heated, the dye reacts with the acid, shifts to its coloured form, thereby producing an image. Since thermal printers only have one or two moving components, they are very reliable and economical to operate and easy to maintain. Moreover, thermal printheads are usually much smaller and lighter than the printing elements used by other printing technologies, which makes them ideal for portable applications such as portable receipt or ticket printing.

However, since thermal printing devices and thermal papers are widely available, it is relatively easy to produce fake thermally-printed articles, which are difficult to distinguish from genuine articles. Moreover, thermally printed tickets are often simply photocopied.

Another commonly used method to produce forged tickets is to manipulate or erase the thermal print on a genuine ticket. For example, in case the leuco dye included in the thermochromic coating layer is pH sensitive, it can be reconverted into its colourless form by adding an acid or base. Said erased ticket can then be newly printed with falsified information.

U.S. Pat. No. 6,060,426 relates to a thermosensitive recording comprising a near infrared fluorescent compound as security feature. Thermally-imageable articles which allow verification of the genuineness of the article including a light transmissive/reflective platy pigment in or on one or both surfaces of the article are described in WO 99/19150 A1.

WO 2015/181056 A9 relates to a method of manufacturing a surface-modified material, wherein a substrate comprising a coating layer containing a salifiable alkaline or alkaline earth compound, is treated with a liquid composition comprising an acid to form a surface-modified region on the coating layer.

EP 3 067 214 A1 discloses a method for creating a hidden pattern, wherein a liquid treatment composition comprising an acid is applied onto a substrate comprising an external surface comprising a salifiable alkaline or alkaline earth compound.

EP 3 173 522 A1 relates to a method of tagging a substrate with a covert, spectroscopically detectable security feature, wherein a liquid treatment composition comprising an acid is deposited onto a substrate comprising an external surface comprising a salifiable alkaline or alkaline earth compound. A method of manufacturing a substrate with an embedded, UV-visible pattern, wherein a liquid treatment composition comprising an acid is deposited onto a substrate, which comprises at least one optical brightener and optionally a filler, is described in EP 3 173 247 A1.

For completeness, the applicant would like to mention the unpublished European patent application with filing number 16 188 656.9 in its name, which relates to patterning of natural products, and the unpublished European patent application with filing number 16 188 665.0 in its name, which relates to a method for improving the slip resistance of a substrate.

Consequently, there is an increasing demand for security elements that can be used to verify the authenticity of a thermally printed document, such as point-of-sale receipts, airline boarding passes, entertainment tickets, transportation tickets, or labels.

Accordingly, it is an object of the present invention to provide a method for creating a reliable security element in a thermal print medium, which is difficult to counterfeit, and allows a simple and immediate authentication. It is also desirable that the method is easy to implement in existing print facilities. It is also desirable that the method is suitable for both small and large production volume. Furthermore, it is desirable that the method can be used for a great variety of substrates, and does not affect the properties of the substrates in a negative way.

It is also an object of the present invention to provide a security element, which is observable for the human eye under ambient conditions, and thus, does not require the use of any verification tools. It is also desirable that the security element can be equipped with further functionalities making it machine readable and is combinable with prior art security elements.

The foregoing and other objects are solved by the subject-matter as defined herein in the independent claims.

According to one aspect of the present invention, a method of manufacturing a tamper-proof medium for thermal printing is provided, the method comprising the following steps:

a) providing a substrate, wherein the substrate comprises on at least one side a thermochromic coating layer comprising at least one halochromic leuco dye,
b) providing a liquid treatment composition comprising at least one acid, and
c) applying the liquid treatment composition onto at least one region of the thermochromic coating layer in form of a preselected pattern.

According to another aspect of the present invention, a tamper-proof medium for thermal printing obtainable by a method according to the present invention is provided.

According to still another aspect of the present invention, use of a tamper-proof medium for thermal printing according to the present invention is provided in security applications, in overt security elements, in covert security elements, in brand protection, in deviation prevention, in microlettering, in micro imaging, in decorative applications, in artistic applications, in visual applications, in packaging applications, in printing applications, in monitoring applications, or in track and trace applications.

Advantageous embodiments of the present invention are defined in the corresponding sub-claims.

According to one embodiment the substrate is selected from the group comprising paper, cardboard, containerboard, plastic, cellophane, textile, wood, metal, glass, mica plate, or nitrocellulose, preferably paper, cardboard, containerboard, or plastic.

According to another embodiment the at least one halochromic leuco dye is colourless. According to still another embodiment the at least one halochromic leuco dye is selected from the group consisting of arylmethane phthalide dyes, quinone dyes, triarylmethane dyes, triphenylmethane dyes, fluoran dyes, phenothiazine dyes, rhodamine lactam dyes, spiropyran dyes, and mixtures thereof.

According to one embodiment the thermochromic coating layer comprises the at least one halochromic leuco dye in an amount from 1 to 60 wt.-%, preferably from 5 to 55 wt.-%, more preferably from 10 to 50 wt.-%, even more preferably from 15 to 45 wt.-%, and most preferably from 20 to 40 wt.-%, based on the total weight of the thermochromic coating layer. According to another embodiment the thermochromic coating layer further comprises a colour developing agent, preferably in an amount from 1 to 80 wt.-%, preferably from 10 to 75 wt.-%, more preferably from 20 to 70 wt.-%, even more preferably from 30 to 65 wt.-%, and most preferably from 40 to 60 wt.-%, based on the total weight of the thermochromic coating layer.

According to one embodiment the at least one acid is selected from the group consisting of hydrochloric acid, sulphuric acid, sulphurous acid, phosphoric acid, citric acid, oxalic acid, acetic acid, formic acid, sulphamic acid, tartaric acid, phytic acid, boric acid, succinic acid, suberic acid, benzoic acid, adipic acid, pimelic acid, azelaic acid, sebaic acid, isocitric acid, aconitic acid, propane-1,2,3-tricarboxylic acid, trimesic acid, glycolic acid, lactic acid, mandelic acid, acidic organosulfur compounds, acidic organophosphorus compounds, $HSO_4^-$, $H_2PO_4^-$ or $HPO_4^{2-}$, being at least partially neutralized by a corresponding cation selected from $Li^+$, $Na^+$, $K^+$, $Mg^{2+}$ or $Ca^{2+}$, and mixtures thereof, preferably the at least one acid is selected from the group consisting of hydrochloric acid, sulphuric acid, sulphurous acid, phosphoric acid, oxalic acid, boric acid, suberic acid, succinic acid, sulphamic acid, tartaric acid, and mixtures thereof, more preferably the at least one acid is selected from the group consisting of sulphuric acid, phosphoric acid, boric acid, suberic acid, sulphamic acid, tartaric acid, and mixtures thereof, and most preferably the at least one acid is phosphoric acid.

According to one embodiment the liquid treatment composition further comprises a dye, a pigment, a fluorescent dye, a phosphorescent dye, an ultraviolet absorbing dye, a near infrared absorbing dye, a thermochromic dye, a halochromic dye, metal ions, transition metal ions, lanthanides, actinides, magnetic particles, quantum dots, or a mixture thereof, and preferably the liquid treatment composition comprises a dye, and most preferably a solvent-soluble dye. According to another embodiment the liquid treatment composition comprises the at least one acid in an amount from 0.1 to 100 wt.-%, based on the total weight of the liquid treatment composition, preferably in an amount from 1 to 80 wt.-%, more preferably in an amount from 3 to 60 wt.-%, and most preferably in an amount from 10 to 50 wt.-%.

According to one embodiment the preselected pattern is a continuous layer, a pattern, a pattern of repetitive elements and/or a repetitive combination(s) of elements, preferably the preselected pattern is a guilloche, a one-dimensional bar code, a two-dimensional bar code, a three-dimensional bar code, a QR-code, a dot matrix code, a security mark, a number, a letter, an alphanumeric symbol, a logo, an image, a shape, a signature, a design, or a combination thereof. According to another embodiment the liquid treatment composition is applied by spray coating, inkjet printing, offset printing, flexographic printing, screen printing, plotting, contact stamping, rotogravure printing, spin coating, slot coating, curtain coating, slide bed coating, film press, metered film press, blade coating, brush coating, stamping and/or a pencil, and preferably by inkjet printing.

According to one embodiment the tamper-proof medium is a branded product, a security document, a non-secure document, or a decorative product, preferably the product is a packaging, a container, a compact disc (CD), a digital video disc (DVD), a blue ray disc, a sticker, a label, a seal, a tag, a poster, a passport, a driving licence, a bank card, a credit card, a bond, a ticket, a postage stamp, tax stamp, a banknote, a certificate, a brand authentication tag, a business card, a greeting card, a voucher, a tax banderol, a point-of-sale receipt, a plot, a fax, a continuous recording sheet or reel, or a wall paper.

It should be understood that for the purpose of the present invention, the following terms have the following meaning.

For the purpose of the present invention, an "acid" is defined as Brønsted-Lowry acid, that is to say, it is an $H_3O^+$ ion provider. An "acidic salt" is defined as an $H_3O^+$ ion-provider, e.g., a hydrogen-containing salt, which is partially neutralised by an electropositive element. A "salt" is defined as an electrically neutral ionic compound formed from anions and cations. A "partially crystalline salt" is defined as a salt that, on XRD analysis, presents an essentially discrete diffraction pattern. In accordance with the present invention, $pK_a$, is the symbol representing the acid dissociation constant associated with a given ionisable hydrogen in a given acid, and is indicative of the natural degree of dissociation of this hydrogen from this acid at equilibrium in water at a given temperature. Such $pK_a$ values may be found in reference textbooks such as Harris, D. C. "Quantitative Chemical Analysis: 3rd Edition", 1991, W.H. Freeman & Co. (USA), ISBN 0-7167-2170-8.

The term "basis weight" as used in the present invention is determined according to DIN EN ISO 536:1996, and is defined as the weight in $g/m^2$.

For the purpose of the present invention, the term "coating layer" refers to a layer, covering, film, skin etc., formed, created, prepared etc., from a coating formulation which remains predominantly on one side of the substrate. The coating layer can be in direct contact with the surface of the substrate or, in case the substrate comprises one or more precoating layers and/or barrier layers, can be in direct contact with the top precoating layer or barrier layer, respectively.

In the meaning of the present invention, the term "halochromic" refers to the property of a substance or material to change colour due to a change in pH.

For the purpose of the present invention, a "laminate" refers to a sheet of material, which can be applied over a substrate and bonded to the substrate, thereby forming a laminated substrate.

A "leuco dye" in the meaning of the present invention refers to a dye which can switch between two chemical forms, one of which can be colourless. Reversible transformations can be caused by heat, light and/or pH, i.e. the leuco dye can be thermochromic, photochromic or halochromic, respectively.

The term "liquid treatment composition" as used herein, refers to a composition in liquid from, which comprises at least one acid, and can be applied the thermochromic coating layer of the substrate of the present invention.

"Ground calcium carbonate" (GCC) in the meaning of the present invention is a calcium carbonate obtained from natural sources, such as limestone, marble, or chalk, and processed through a wet and/or dry treatment such as grinding, screening and/or fractionating, for example, by a cyclone or classifier.

"Modified calcium carbonate" (MCC) in the meaning of the present invention may feature a natural ground or precipitated calcium carbonate with an internal structure modification or a surface-reaction product, i.e. "surface-reacted calcium carbonate". A "surface-reacted calcium carbonate" is a material comprising calcium carbonate and water-insoluble, preferably at least partially crystalline, calcium salts of anions of acids on the surface. Preferably, the insoluble calcium salt extends from the surface of at least a part of the calcium carbonate. The calcium ions forming said at least partially crystalline calcium salt of said anion originate largely from the starting calcium carbonate material. MCCs are described, for example, in US 2012/0031576 A1, WO 2009/074492 A1, EP 2 264 109 A1, WO 00/39222 A1, or EP 2 264 108 A1.

"Precipitated calcium carbonate" (PCC) in the meaning of the present invention is a synthesised material, obtained by precipitation following reaction of carbon dioxide and lime in an aqueous, semi-dry or humid environment or by precipitation of a calcium and carbonate ion source in water. PCC may be in the vateritic, calcitic or aragonitic crystal form. PCCs are described, for example, in EP 2 447 213 A1, EP 2 524 898 A1, EP 2 371 766 A1, EP 1 712 597 A1, EP 1 712 523 A1, or WO 2013/142473 A1.

Throughout the present document, the "particle size" of a salifiable alkaline or alkaline earth compound is described by its distribution of particle sizes. The value $d_x$ represents the diameter relative to which x % by weight of the particles have diameters less than $d_x$. This means that the $d_{20}$ value is the particle size at which 20 wt.-% of all particles are smaller, and the $d_{75}$ value is the particle size at which 75 wt.-% of all particles are smaller. The $d_{50}$ value is thus the weight median particle size, i.e. 50 wt.-% of all grains are bigger and the remaining 50 wt.-% are smaller than this particle size. For the purpose of the present invention the particle size is specified as weight median particle size $d_{50}$ unless indicated otherwise. For determining the weight median particle size $d_{50}$ value a Sedigraph can be used. The method and the instrument are known to the skilled person and are commonly used to determine grain size of fillers and pigments. The samples are dispersed using a high speed stirrer and ultrasonics.

A "specific surface area (SSA)" of a salifiable alkaline or alkaline earth compound in the meaning of the present invention is defined as the surface area of the compound divided by its mass. As used herein, the specific surface area is measured by nitrogen gas adsorption using the BET isotherm (ISO 9277:2010) and is specified in $m^2/g$.

For the purpose of the present invention, a "rheology modifier" is an additive that changes the rheological behaviour of a slurry or a liquid coating composition to match the required specification for the coating method employed.

A "salifiable" compound in the meaning of the present invention is defined as a compound that is capable of reacting with an acid to form a salt. Examples of salifiable compounds are alkaline or alkaline earth oxides, hydroxides, alkoxides, methylcarbonates, hydroxycarbonates, bicarbonates, or carbonates.

For the purpose of the present invention, the term "surface-modified region" refers to a distinct spatial area, in which the salifiable alkaline or alkaline earth compound of the external surface has been at least partially converted into an acid salt as a result of the application of the liquid treatment composition comprising at least one acid. Accordingly, a "surface-modified region" in the meaning of the present invention comprises at least one acid salt of the salifiable alkaline or alkaline earth compound of the external surface and the at least one acid comprised in the liquid treatment composition. The surface-modified region will have a different chemical composition and crystal structure compared to the original material.

In the meaning of the present invention, a "surface-treated calcium carbonate" is a ground, precipitated or modified calcium carbonate comprising a treatment or coating layer, e.g. a layer of fatty acids, surfactants, siloxanes, or polymers.

In the present context, the term "substrate" is to be understood as any material having a surface suitable for printing, coating or painting on, such as paper, cardboard, containerboard, plastic, cellophane, textile, wood, metal, glass, mica plate, or nitrocellulose. The mentioned examples are, however, not of limitative character.

In the meaning of the present invention, the term "thermochromic" refers to the property of a substance or material to change colour due to a change in temperature.

For the purpose of the present invention, the "thickness" and "layer weight" of a layer refers to the thickness and layer weight, respectively, of the layer after the applied coating composition has been dried.

For the purpose of the present invention, the term "viscosity" or "Brookfield viscosity" refers to Brookfield viscosity. The Brookfield viscosity is for this purpose measured by a Brookfield DV-II+ Pro viscometer at 25° C.±1° C. at 100 rpm using an appropriate spindle of the Brookfield RV-spindle set and is specified in mPa·s. Based on his technical knowledge, the skilled person will select a spindle from the Brookfield RV-spindle set which is suitable for the viscosity range to be measured.

For example, for a viscosity range between 200 and 800 mPa·s the spindle number 3 may be used, for a viscosity range between 400 and 1 600 mPa·s the spindle number 4 may be used, for a viscosity range between 800 and 3 200 mPa·s the spindle number 5 may be used, for a viscosity range between 1 000 and 2 000 000 mPa·s the spindle number 6 may be used, and for a viscosity range between 4 000 and 8 000 000 mPa·s the spindle number 7 may be used.

A "suspension" or "slurry" in the meaning of the present invention comprises insoluble solids and water, and optionally further additives, and usually contains large amounts of solids and, thus, is more viscous and can be of higher density than the liquid from which it is formed.

Where the term "comprising" is used in the present description and claims, it does not exclude other elements. For the purposes of the present invention, the term "consisting of" is considered to be a preferred embodiment of the term "comprising of". If hereinafter a group is defined to comprise at least a certain number of embodiments, this is also to be understood to disclose a group, which preferably consists only of these embodiments.

Whenever the terms "including" or "having" are used, these terms are meant to be equivalent to "comprising" as defined above.

Where an indefinite or definite article is used when referring to a singular noun, e.g. "a", "an" or "the", this includes a plural of that noun unless something else is specifically stated.

Terms like "obtainable" or "definable" and "obtained" or "defined" are used interchangeably. This e.g. means that, unless the context clearly dictates otherwise, the term "obtained" does not mean to indicate that e.g. an embodiment must be obtained by e.g. the sequence of steps following the term "obtained" even though such a limited understanding is always included by the terms "obtained" or "defined" as a preferred embodiment.

According to the present invention a method of manufacturing a tamper-proof medium for thermal printing is provided. The method comprises the steps of (a) providing a substrate, wherein the substrate comprises on at least one side a thermochromic coating layer comprising at least one halochromic leuco dye, (b) providing a liquid treatment composition comprising at least one acid, and (c) applying the liquid treatment composition onto at least one region of the thermochromic coating layer in form of a preselected pattern.

In the following the details and preferred embodiments of the inventive method will be set out in more details. It is to be understood that these technical details and embodiments also apply to the inventive tamper-proof medium for thermal printing and the inventive use thereof.

Method Step a): Substrate

According to step a) of the method of the present invention, a substrate is provided.

The substrate serves as support for the thermochromic coating layer and may be opaque, translucent, or transparent.

According to one embodiment, the substrate is selected from the group comprising paper, cardboard, containerboard, plastic, cellophane, textile, wood, metal, glass, mica plate, or nitrocellulose. According to a preferred embodiment, the substrate is selected from the group comprising paper, cardboard, containerboard, or plastic.

According to an exemplary embodiment, the substrate is paper, cardboard, or containerboard.

According to another embodiment, the substrate is a laminate of paper, plastic and/or metal, wherein preferably the plastic and/or metal are in form of thin foils such as for example used in Tetra Pak. However, any other material having a surface suitable for printing, coating or painting on may also be used as substrate.

According to one embodiment of the present invention, the substrate is paper, cardboard, or containerboard. Cardboard may comprise carton board or boxboard, corrugated cardboard, or non-packaging cardboard such as chromoboard, or drawing cardboard. Containerboard may encompass linerboard and/or a corrugating medium. Both linerboard and a corrugating medium are used to produce corrugated board. The paper, cardboard, or containerboard substrate can have a basis weight from 10 to 1 000 g/m$^2$, from 20 to 800 g/m$^2$, from 30 to 700 g/m$^2$, or from 50 to 600 g/m$^2$. According to one embodiment, the substrate is paper, preferably having a basis weight from 10 to 400 g/m$^2$, 20 to 300 g/m$^2$, 30 to 200 g/m$^2$, 40 to 100 g/m$^2$, 50 to 90 g/m$^2$, 60 to 80 g/m$^2$, or about 70 g/m$^2$.

According to another embodiment, the substrate is a plastic substrate. Suitable plastic materials are, for example, polyethylene, polypropylene, polyvinylchloride, polyesters, polycarbonate resins, or fluorine-containing resins, preferably polypropylene. Examples for suitable polyesters are poly(ethylene terephthalate), poly(ethylene naphthalate) or poly(ester diacetate). An example for a fluorine-containing resins is poly(tetrafluoro ethylene). The plastic substrate may be filled by a mineral filler, an organic pigment, an inorganic pigment, or mixtures thereof.

The substrate may consist of only one layer of the above-mentioned materials or may comprise a layer structure having several sublayers of the same material or different materials. According to one embodiment, the substrate is structured by one layer.

According to another embodiment the substrate is structured by at least two sublayers, preferably three, five, or seven sublayers, wherein the sublayers can have a flat or non-flat structure, e.g. a corrugated structure. Preferably the sublayers of the substrate are made from paper, cardboard, containerboard and/or plastic.

The substrate may be permeable or impermeable for solvents, water, or mixtures thereof. According to one embodiment, the substrate is impermeable for water, solvents, or mixtures thereof. Examples for solvents aliphatic alcohols, ethers and diethers having from 4 to 14 carbon atoms, glycols, alkoxylated glycols, glycol ethers, alkoxylated aromatic alcohols, aromatic alcohols, mixtures thereof, or mixtures thereof with water.

Method Step a): Thermochromic Coating Layer

According to the present invention, the substrate comprises on at least one side a thermochromic coating layer comprising at least one halochromic leuco dye.

A "thermochromic coating layer" in the meaning of the present invention refers to a thermal sensitive or thermal reactive coating layer, which can develop colour through an instantaneous reaction when heated by using, for example, a thermal head, a hot stamp, a hot pen, or laser light. Thermochromic coating layers are well-known in the art and may comprise a colorant, a colour developing agent, and in some systems, a sensitizer. The colorant typically used in thermochromic coating layers is a leuco dye, which is colourless or pale coloured at room temperature, and undergoes a structural change when protonated in the presence of heat and a proton donor, i.e. a colour developing agent. The application of heat causes the components to melt, triggering the transfer of the proton from the developing agent to the leuco dye, causing the leuco dye molecule to change structure to form a visible colour.

Thermochromic coating layers are, for example, described in EP 0 968 837 A1 or EP 1 448 397 A1.

The thermochromic coating layer of the present invention comprises at least one halochromic leuco dye. This means that said at least one leuco dye is sensitive to pH variations and may change its colour due to a change in pH.

The at least one halochromic leuco dye may be colourless. According to one embodiment, the at least one halochromic leuco dye is colourless at a pH from 3 to 14, preferably from 4 to 14, more preferably 5 to 14, and most preferably from 6 to 14.

The thermochromic coating layer may comprise only one type of halochromic leuco dye, or two or more types of halochromic leuco dyes. According to one embodiment of the present invention, the thermochromic coating layer may comprise a first halochromic leuco and a second halochromic leuco dye. This may provide, for example, the possibility to adapt the first halochromic leuco dye to the composition of the liquid treatment composition provided in the step b) of the method of the present invention, and to adapt the second halochromic leuco dye to a colour developing agent, which may be included in the thermochromic coating layer.

According to one embodiment, the thermochromic coating layer comprises at least one halochromic leuco dye, and a colour developing agent. According to another embodiment, the thermochromic coating layer comprises a first halochromic leuco dye, a second halochromic leuco dye, and a colour developing agent.

All leuco dyes well known in the art and being halochromic, may be used in the thermochromic coating layer of the present invention. According to one embodiment, the thermochromic coating layer comprises at least one leuco dye selected from the group consisting of arylmethane phthalide dyes, quinone dyes, triarylmethane dyes, triphenylmethane dyes, fluoran dyes, phenothiazine dyes, rhodamine lactam dyes, spiropyran dyes, or mixtures thereof. According to a preferred embodiment, the thermochromic coating layer comprises at least one leuco dye selected from the group consisting of arylmethane phthalide dyes, triarylmethane dyes, triphenylmethane dyes, fluoran dyes, spiropyran dyes, or mixtures thereof.

Examples of suitable arylmethane phthalide dyes are 3,3-bis(p-dimethyl aminophenyl)-6-dimethylaminophthalide (also known as crystal violet lactone), 3,3-bis(p-dimethyl aminophenyl) phthalide (also known as malachite green lactone), 3,3-bis-[2-(p-dimethyl aminophenyl)-2-(p-methoxyphenyl) ethenyl]-4,5,6,7-tetrabromophthalide, 3,3-bis-[1,1-bis(4-pyrolidinophenyl) ethylene-2-yl]-4,5,6,7-tetrabromophthalide, or derivates thereof.

Examples of suitable flouran dyes are 3-diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino) fluorane, 3-diethylamino-6-methyl-7-(o-chloroanilino) fluorane, 3-diethylamino-6-methyl-7-(p-chloroanilino) fluorane, 3-diethylamino-6-methyl-7-(o-fluoroanilino) fluorane, 3-diethylamino-6-methyl-7-(m-methylanilino) fluorane, 3-diethylamino-6-methyl-7-n-octylanilino fluorane, 3-diethylamino-6-methyl-7-n-octylamino fluorane, 3-diethylamino-6-methyl-7-benzylamino fluorane, 3-diethylamino-6-methyl-7-dibenzylamino fluorane, 3-diethylamino-6-chloro-7-methyl fluorane, 3-diethylamino-6-chloro-7-anilino fluorane, 3-diethylamino-6-chloro-7-p-methylanilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanilino) fluorane, 3-diethylamino-7-(o-chloroanilino) fluorane, 3-diethylamino-7-(p-chloroanilino) fluorane, 3-diethylamino-7-(o-fluoroanilino) fluorane, 3-diethylamino-benz[a]fluorane, 3-diethylamino-benz[c]fluorane, 3-dibutylamino-6-methyl-fluorane, 3-dibutylamino-6-methyl-7-anilino fluorane, 3-dibutylamino-6-methyl-7-(o,p-dimethylanilino) fluorane, 3-dibutylamino-7-(o-chloroanilino) fluorane, 3-butylamino-6-methyl-7-(p-chloroanilino) fluorane, 3-dibutylamino-6-methyl-7-(o-fluoroanilino) fluorane, 3-dibutylamino-6-methyl-7-(m-fluoroanilino) fluorane, 3-dibutylamino-6-methyl-chloro fluorane, 3-dibutylamino-6-ethoxyethyl-7-anilino fluorane, 3-dibutylamino-6-chloro-7-anilino fluorane, 3-dibutylamino-6-methyl-7-p-methylanilino fluorane, 3-dibutylamino-7-(o-chloroanilino) fluorane, 3-dibutyl-amino-7-(o-fluoroanilino) fluorane, 3-di-n-pentylamino-6-methyl-7-anilino fluorane, 3-di-n-pentylamino-6-methyl-7-(p-chloroanilino) fluorane, 3-di-n-pentylamino-7-(m-trifluoromethylanilino) fluorane, 3-di-n-pentylamino-6-chloro-7-anilino fluorane, 3-di-n-pentylamino-7-(p-chloroanilino) fluorane, 3-pyrolidino-6-methyl-7-anilino fluorane, 3-piperidino-6-methyl-7-anilino fluorane, 3-(N-methyl-N-propylamino)-6-methyl-7-anilino fluorane, 3-(N-methyl-N-cyclohexylamino)-6-methyl-7-anilino fluorane, 3-(N-ethyl-N-cyclohexylamino)-6-methyl-7-anilino fluorane, 3-(N-ethyl-N-xylylamino)-6-methyl-7-(p-chloroanilino) fluorane, 3-(N-ethyl-p-toluidino)-6-methyl-7-anilino fluorane, 3-(N-ethyl-N-isoamylamino)-6-methyl-7-anilino fluorane, 3-(N-ethyl-N-isoamylamino)-6-chloro-7-anilino fluorane, 3-(N-ethyl-N-tetrahydro-furfurylamino)-6-methyl-7-anilino fluorane, 3-(N-ethyl-N-isobutylamino)-6-methyl-7-anilino fluorane, 3-(N-ethyl-N-ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-o-(p-dimethylaminophenyl) aminoanilino fluorane, 2-methoxy-6-p-(p-dimethylaminophenyl) aminoanilino fluorane, 2-chloro-3-methyl-6-p-(p-phenylaminophenyl) aminoanilino fluorane, 2-chloro-6-p-(p-dimethylaminophenyl) aminoanilino fluorane, 2-nitro-6-p-(p-diethylaminophenyl) aminoanilino fluorane, 2-amino-6-p-(p-diethylaminophenyl) aminoanilino fluorane, 2-diethylamino-6-p-(p-diethylaminophenyl) aminoanilino fluorane, 2-phenyl-6-methyl-6-p-(p-phenylaminophenyl) aminoanilino fluorane, 2-benzyl-6-p-(p-phenylaminophenyl) aminoanilino fluorane, 2-hydroxy-6-p-(p-phenylaminophenyl)aminoanilino fluorane, 3-methyl-6-p-(p-dimethylaminophenyl) aminoanilino fluorane, 3-diethylamino-6-p-(p-diethylaminophenyl) aminoanilino fluorane, 3-diethylamino-6-p-(p-dibutylaminophenyl) aminoanilino fluorane, 2,4-dimethyl-6-[(4-dimethylamino) anilino]fluorane, or mixtures thereof.

Examples of suitable triarylmethane dyes, and preferably triphenylmethane dyes, are methyl violet dyes, e.g. methyl violet 2B, methyl violet 6B, or methyl violet 10B; fuchsine dyes, e.g. pararosaniline, or fuchsine; phenol dyes, e.g. phenol red, chlorophenol red, cresol red, bromocresol purple, or bromocresol green; malachite green dyes, e.g. malachite green, brilliant green, or brilliant blue FCF; or victoria blue dyes, e.g., victoria blue B, victoria blue FBR, victoria blue BO, victoria blue FGA, victoria blue 4R, or victoria blue R.

Examples of suitable spiropyran dyes are 3,6,6-tris(dimethylamino) spiro[fluorane-9,3'-phthalide], 3,6,6'-tris (diethylamino) spiro[fluorane-9,3'-phthalide], or derivates thereof.

Examples of further suitable leuco dyes are 3-(4-diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, 3-(4-cyclohexyl 1 ethylamino-2-methoxyphenyl)-3-(1-ethyl-2-methylindol-3-yl)-4-azaphthalide, 3,3-bis(1-ethyl-2-methylindol-3-yl) phthalide, 3,6-bis(diethylamino)fluorane-γ-(3'-nitroanilinolactam, 3,6-bis(diethylamino)fluorane-γ-(4'-nitro) anilinolactam, 1,1-bis-[2',2',2",2"-tetrakis-(p-dimethylaminophenyl)-ethenyl]-2,2-dinitrilethane, 1,1-bis-[2',2',2",2"-tetrakis-(p-dimethylaminophenyl)-ethenyl]-2-6-naphthoylethane, 1,1-bis-[2',2',2",2"-tetrakis-(p-dimethylaminophenyl)-ethenyl]-2,2-diacetylethane, or bis-[2,2,2',2'-tetrakis-(p-dimethylaminophenyl)-ethenyl]-methylmalonic acid dimethyl ester.

All colour developing agents well known in the art may be used in the thermochromic coating layer of the present invention. The skilled person will select the colour developing agent depending on the at least one leuco dye. Examples of suitable colour developing agents are activated clay, attapulgite, colloidal silica, inorganic acidic substances such as aluminum silicate, 4,4'-isopropylidene diphenol (bisphenol A), 1,1-bis(4-hydroxyphenyl) cyclohexane, 2,2-bis(4-hydroxyphenyl)-4-methylpentane, 4,4'-dihydroxydiphenyl sulfide, hydroquinone monobenzyl ether, benzyl 4-hydroxy-benzoate, 4,4'-dihydroxy diphenyl sulfone, 2,4'-dihydroxy diphenyl sulfone, 4-hydroxy-4'-isopropxy diphenyl sulfone, 4-hydroxy-4'-n-propoxy diphenyl sulfone, bis (3-allyl-4-hydroxyphenyl) sulfone, 4-hydroxy-4'-methyl diphenyl sulfone, 4-hydroxyphenyl-4'-benzyloxyphenyl sulfone, 3,4-dihydroxy-phenyl-4'-methyl phenyl sulfone, 1-[4-(4-hydroxyphenyl-sulfonyl) phenoxy]-4-[4-(4-isopropoxyphenyl sulfonyl) phenoxy]butane, bis(4-hydroxyphenyl thioethoxy) methane, 1,5-di(4-hydroxyphenyl thio)-3-oxapentane, butyl bis(p-hydroxyphenyl) acetate, methyl bis(p-hydroxyphenyl) acetate, 1,1-bis(4-hydroxyphenyl)-1-phenyl ethane, 1,4-bis[α-methyl-α-(4'-hydroxyphenyl)

ethyl]benzene, 1,3-bis[α-methyl-α-(4'-hydroxyphenyl)-ethyl]benzene, di(4-hydroxy-3-methylphenyl) sulfide, 2,2'-thio-bis(3-tert-octylphenol), 2,2'-thiobis(4-tert-octylphenol), thiourea compounds such as N,N'-di-m-chlorophenyl, p-chlorobenzoic acid, stearyl gallate, bis[zinc 4-octyloxy carbonylamino]salicylate dihydrate, 4-[2-(p-methoxyphenoxy) ethyloxy]salicylic acid, 4-[3-(p-trisulfonyl) propyloxy]salicylic acid, aromatic carboxylic acids such as 5-[p-(2-p-methoxyphenoxyethoxy) cumyl]salicylic acid and salts of these aromatic carboxylic acids and polyvalent metals such as zinc, magnesium, aluminum, calcium, titanium, manganese, tin, nickel. These colour development agents may be used individually and in mixtures of at least two. Preferred colour developers are phenol compounds and organic acids, which melt at a temperature from 50 to 250° C.

According to one embodiment, the colour developing agent is selected from the group consisting of bisphenol A, 4-hydroxyphthalic acid ester, 4-hydroxy-phthalic acid diester, phthalic acid monoester, bis-(hydroxyphenyl)sulfide, 4-hydroxy-phenylarylsulfone, 4-hydroxyphenylarylsulfonate, 1,3-di[2-(hydroxyphenyl)-2-propyl]benzene, 4-hydroxybenzoyloxybenzoic acid ester, bis-phenolsulfone and derivates and mixtures thereof. Preferably the colour developing agent may be selected from the group consisting of 4,4'-isopropylidenediphenol (bisphenol A), 4,4'-cyclohexylidenediphenol, p,p'-(1-methyl-n-hexylidene)diphenol, 1,7-di-(hydroxyphenylthio)-3,5-dioxaheptane, 4-hydroxybenzyl benzoate, 4-hydroxy-ethyl benzoate, 4-hydroxypropyl benzoate, 4-hydroxyisopropyl benzoate, 4-hydroxybutyl benzoate, 4-hydroxyisobutyl benzoate, 4-hydroxymethylbenzyl benzoate, 4-hydroxydimethyl phthalate, 4-hydroxydiisopropyl phthalate, 4-hydroxydibenzyl phthalate, 4-hydroxydihexyl phthalate, monobenzyl phthalate, monocyclohexyl phthalate, monophenyl phthalate, monomethylphenyl phthalate, monoethylphenyl phthalate, monopropylbenzyl phthalate, monohalogenbenzyl phthalate, monoethoxy-benzyl phthalate, bis-(4-hydroxy-3-tert-butyl-6-methylphenyl)sulfide, bis-(4-hydroxy-2,5-dimethylphenyl)sulfide, bis-(4-hydroxy-2-methyl-5-ethylphenyl)sulfide, bis-(4-hydroxy-2-methyl-5-isopropylphenyl) sulfide, bis-(4-hydroxy-2,3-dimethyl-phenyl)sulfide, bis-(4-hydroxy-2,5-dimethylphenyl)sulfide, bis-(4-hydroxy-2,5-diiso-propylphenyl)sulfide, bis-(4-hydroxy-2,3,6-trimethylphenyl)sulfide, bis-(2,4,5-tri-hydroxyphenyl) sulfide, bis-(4-hydroxy-2-cyclohexyl-5-methylphenyl) sulfide, bis-(2,3,4-trihydroxyphenyl)sulfide, bis-(4,5-dihydroxy-2-tert-butylphenyl)sulfide, bis-(4-hydroxy-2,5-diphenylphenyl)sulfide, bis-(4-hydroxy-2-tert-octyl-5-methyl-phenyl)sulfide, 4-hydroxy-4'-isopropoxy-diphenylsulfone, 4-hydroxy-4'-n-butyloxy-diphenylsulfone, 4-hydroxy-4'-n-propoxydiphenylsulfone, 4-hydroxyphenyl-benzenesulfonate, 4-hydroxyphenyl-p-tolylsulfonate, 4-hydroxyphenylmethylene-sulfonate, 4-hydroxyphenyl-p-chlorobenzenesulfonale, 4-hydroxyphenyl-p-tert-butylbenzenesulfonate, 4-hydroxyphenyl-p-isopropoxybenzenesulfonate, 4-hydroxy-phenyl-1'-naphthalenesulfonate, 4-hydroxyphenyl-2'-naphthalenesulfonate, 1,3-di[2-(4-hydroxyphenyl)-2-propyl]benzene, 1,3-di[2-(4-hydroxy-3-alkylphenyl)-2-propyl]-benzene, 1,3-di[2-(2,4-dihydroxyphenyl)-2-propyl] benzene, 1,3-di[2-(2-hydroxy-5-methylphenyl)-2-propyl] benzene, 1,3-dihydroxy-6(α,α-dimethylhenzyl)-benzene, 4-hydroxybenzoyloxybenzyl benzoate, 4-hydroxybenzoyloxymethyl benzoate, 4-hydroxybenzoyloxyethyl benzoate, 4-hydroxybenzoyloxypropyl benzoate, 4-hydroxybenzoyloxybutyl benzoate, 4-hydroxybenzoyloxyisopropyl benzoate, 4-hydroxybenzoyloxytert-butyl benzoate, 4-hydroxybenzoyloxyhexyl benzoate, 4-hydroxybenzoyloxyoctyl benzoate, 4-hydroxybenzoyloxynonyl benzoate, 4-hydroxybenzoyloxycyclohexyl benzoate, 4-hydroxybenzoyloxy β-phenethyl benzoate, 4-hydroxybenzoyloxyphenyl benzoate, 4-hydroxybenzoyloxy α-naphthyl benzoate, 4-hydroxybenzoyloxy 3-naphthyl benzoate, 4-hydroxybenzoyloxysec-butyl benzoate, bis-(3-1-butyl-4-hydroxy-6-methylphenyl) sulfone, bis-(3-ethyl-4-hydroxyphenyl)sulfone, bis-(3-propyl-4-hydroxyphenyl)sulfone, bis-(3-methyl-4-hydroxyphenyl)sulfone, bis-(2-isopropyl-4-hydroxyphenyl) sulfone, bis-(2-ethyl-4-hydroxyphenyl)sulfone, bis-(3-chloro-4-hydroxyphenyl)sulfone, bis-(2,3-dimethyl-4-hydroxyphenyl)sulfone, bis-(2,5-dimethyl-4-hydroxyphenyl)sulfone, bis-(3-methoxy-4-hydroxyphenyl) sulfone, 4-hydroxyphenyl-2'-ethyl-4'-hydroxyphenyl-sulfone, 4-hydroxyphenyl-2'-isopropyl-4'-hydroxyphenylsulfone, 4-hydroxyphenyl-3'-isopropyl-4'-hydroxyphenylsulfone, 4-hydroxyphenyl-3'-sec-butyl-4'-hydroxy-phenylsulfone, 3-chloro-4-hydroxyphenyl-3'-isopropyl-4'-hydroxyphenylsulfone, 2-hydroxy-5-t-butylphenyl-4'-hydroxyphenylsulfone, 2-hydroxy-5-t-aminophenyl-4'-hydroxyphenylsulfone, 2-hydroxy-5-t-isopropylphenyl-4'-hydroxyphenylsulfone, 2-hydroxy-5-t-octylphenyl-4'-hydroxyphenylsulfone, 2-hydroxy-5-t-butylphenyl-3'-chloro-4'-hydroxyphenylsulfone, 2-hydroxy-5-t-butylphenyl-3'-methyl-4'-hydroxy-phenylsulfone, 2-hydroxy-5-t-butylphenyl-3'-isopropyl-4'-hydroxyphenylsulfone, 2-hydroxy-5-t-butylphenyl-2'-methyl-4'-hydroxyphenylsulfone, 4,4'-sulfonyl-diphenol, 2,4'-sulfonyldiphenol, 3,3'-dichloro-4,4'-sulfonyldiphenol, 3,3'-dibromo-4,4'-sulfonyldiphenol, 3,3',5,5'-tetrabromo-4,4'-sulfonyldiphenol, 3,3'-diamino-4,4'-sulfonyldiphenol, p-tert-butylphenol, 2,4-dihydroxybenzophenone, novolac type phenolic resin, 4-hydroxyacetophenone, p-phenylphenol, benzyl-4-hydroxyphenyl-acetate, p-benzylphenol, and mixtures thereof.

The skilled person will select the types and amounts of the leuco dye and the colour developing agent according the required performance and printability.

According to one embodiment of the present invention, the thermochromic coating layer comprises the at least one halochromic leuco dye in an amount from 1 to 60 wt.-%, preferably from 5 to 55 wt.-%, more preferably from 10 to 50 wt.-%, even more preferably from 15 to 45 wt.-%, and most preferably from 20 to 40 wt.-%, based on the total weight of the thermochromic coating layer, and/or the colour developing agent in an amount from 1 to 80 wt.-%, preferably from 10 to 75 wt.-%, more preferably from 20 to 70 wt.-%, even more preferably from 30 to 65 wt.-%, and most preferably from 40 to 60 wt.-%, based on the total weight of the thermochromic coating layer.

Method Step a): Further Embodiments

The thermochromic coating layer may comprise further additional components such as fillers, binders, or sensitizers.

According to one embodiment, the thermochromic coating layer comprises a filler.

The thermochromic coating layer may comprise the filler in an amount from 1 to 50 wt.-%, based on the total weight of the thermochromic coating layer, preferably in an amount from 1 to 40 wt.-%, more preferably from 5 to 30 wt.-%, even more preferably from 10 to 25 wt.-%, and most preferably from 15 to 20 wt.-%.

Examples of suitable fillers are kaolin, calcined kaolin, silica, talc, aluminium oxide, aluminium hydroxide, titanium oxide, zinc oxide, aluminium silicate, magnesium silicate, calcium silicate, diatomaceous earth, salifiable alkaline or alkaline earth compounds, polystyrene resin, urea-formaldehyde resin, hollow plastic pigments, or mixtures thereof.

According to one embodiment, the thermochromic coating layer comprises a salifiable alkaline or alkaline earth compound. The salifiable alkaline or alkaline earth compound may be present in an amount from 1 to 50 wt.-%, based on the total weight of the thermochromic coating layer, preferably in an amount from 1 to 40 wt.-%, more preferably from 5 to 30 wt.-%, even more preferably from 10 to 25 wt.-%, and most preferably from 15 to 20 wt.-%.

According to one embodiment, the salifiable alkaline or alkaline earth compound is an alkaline or alkaline earth oxide, an alkaline or alkaline earth hydroxide, an alkaline or alkaline earth alkoxide, an alkaline or alkaline earth methylcarbonate, an alkaline or alkaline earth hydroxycarbonate, an alkaline or alkaline earth bicarbonate, an alkaline or alkaline earth carbonate, or a mixtures thereof. Preferably, the salifiable alkaline or alkaline earth compound is an alkaline or alkaline earth carbonate.

The alkaline or alkaline earth carbonate may be selected from lithium carbonate, sodium carbonate, potassium carbonate, magnesium carbonate, calcium magnesium carbonate, calcium carbonate, or mixtures thereof. According to one embodiment, the alkaline or alkaline earth carbonate is calcium carbonate, more preferably the alkaline or alkaline earth carbonate is a ground calcium carbonate, a precipitated calcium carbonate, a modified calcium carbonate and/or a surface-treated calcium carbonate, and most preferably a ground calcium carbonate, a precipitated calcium carbonate and/or a surface-treated calcium carbonate. According to a preferred embodiment, the calcium carbonate is ground calcium carbonate.

Ground (or natural) calcium carbonate (GCC) is understood to be manufactured from a naturally occurring form of calcium carbonate, mined from sedimentary rocks such as limestone or chalk, or from metamorphic marble rocks, eggshells or seashells. Calcium carbonate is known to exist as three types of crystal polymorphs: calcite, aragonite and vaterite. Calcite, the most common crystal polymorph, is considered to be the most stable crystal form of calcium carbonate. Less common is aragonite, which has a discrete or clustered needle orthorhombic crystal structure. Vaterite is the rarest calcium carbonate polymorph and is generally unstable. Ground calcium carbonate is almost exclusively of the calcitic polymorph, which is said to be trigonal-rhombohedral and represents the most stable of the calcium carbonate polymorphs. The term "source" of the calcium carbonate in the meaning of the present application refers to the naturally occurring mineral material from which the calcium carbonate is obtained. The source of the calcium carbonate may comprise further naturally occurring components such as magnesium carbonate, alumino silicate etc.

According to one embodiment of the present invention the GCC is obtained by dry grinding. According to another embodiment of the present invention the GCC is obtained by wet grinding and optionally subsequent drying.

In general, the grinding step can be carried out with any conventional grinding device, for example, under conditions such that comminution predominantly results from impacts with a secondary body, i.e. in one or more of: a ball mill, a rod mill, a vibrating mill, a roll crusher, a centrifugal impact mill, a vertical bead mill, an attrition mill, a pin mill, a hammer mill, a pulveriser, a shredder, a de-clumper, a knife cutter, or other such equipment known to the skilled man. In case the calcium carbonate comprising mineral material comprises a wet ground calcium carbonate comprising mineral material, the grinding step may be performed under conditions such that autogenous grinding takes place and/or by horizontal ball milling, and/or other such processes known to the skilled man. The wet processed ground calcium carbonate comprising mineral material thus obtained may be washed and dewatered by well-known processes, e.g. by flocculation, centrifugation, filtration or forced evaporation prior to drying. The subsequent step of drying may be carried out in a single step such as spray drying, or in at least two steps. It is also common that such a mineral material undergoes a beneficiation step (such as a flotation, bleaching or magnetic separation step) to remove impurities.

According to one embodiment of the present invention, the ground calcium carbonate is selected from the group consisting of marble, chalk, dolomite, limestone and mixtures thereof.

According to one embodiment of the present invention, the calcium carbonate comprises one type of ground calcium carbonate. According to another embodiment of the present invention, the calcium carbonate comprises a mixture of two or more types of ground calcium carbonates selected from different sources.

"Precipitated calcium carbonate" (PCC) in the meaning of the present invention is a synthesized material, generally obtained by precipitation following reaction of carbon dioxide and lime in an aqueous environment or by precipitation of a calcium and carbonate ion source in water or by precipitation of calcium and carbonate ions, for example $CaCl_2$ and $Na_2CO_3$, out of solution. Further possible ways of producing PCC are the lime soda process, or the Solvay process in which PCC is a by-product of ammonia production. Precipitated calcium carbonate exists in three primary crystalline forms: calcite, aragonite and vaterite, and there are many different polymorphs (crystal habits) for each of these crystalline forms. Calcite has a trigonal structure with typical crystal habits such as scalenohedral (S-PCC), rhombohedral (R-PCC), hexagonal prismatic, pinacoidal, colloidal (C-PCC), cubic, and prismatic (P-PCC). Aragonite is an orthorhombic structure with typical crystal habits of twinned hexagonal prismatic crystals, as well as a diverse assortment of thin elongated prismatic, curved bladed, steep pyramidal, chisel shaped crystals, branching tree, and coral or worm-like form. Vaterite belongs to the hexagonal crystal system. The obtained PCC slurry can be mechanically dewatered and dried.

According to one embodiment of the present invention, the calcium carbonate comprises one precipitated calcium carbonate. According to another embodiment of the present invention, the calcium carbonate comprises a mixture of two or more precipitated calcium carbonates selected from different crystalline forms and different polymorphs of precipitated calcium carbonate. For example, the at least one precipitated calcium carbonate may comprise one PCC selected from S-PCC and one PCC selected from R-PCC.

According to another embodiment, the salifiable alkaline or alkaline earth compound may be surface-treated material, for example, a surface-treated calcium carbonate.

A surface-treated calcium carbonate may feature a ground calcium carbonate, a modified calcium carbonate, or a precipitated calcium carbonate comprising a treatment or coating layer on its surface. For example, the calcium carbonate may be treated or coated with a hydrophobising agent such as, e.g., aliphatic carboxylic acids, salts or esters thereof, or a siloxane. Suitable aliphatic acids are, for example, $C_5$ to $C_{28}$ fatty acids such as stearic acid, palmitic acid, myristic acid, lauric acid, or a mixture thereof. The calcium carbonate may also be treated or coated to become cationic or anionic with, for example, a polyacrylate or polydiallyldimethyl-ammonium chloride (polyDADMAC). Surface-treated calcium carbonates are, for example, described in EP 2 159 258 A1 or WO 2005/121257 A1. Additionally or alternatively, the hydrophobising agent can be at least one mono-substituted succinic acid and/or salty reaction product(s) and/or at least one phosphoric acid ester blend of one or more phosphoric acid mono-ester and/or reaction products thereof and one or more phosphoric acid di-ester and/or reaction products thereof. Methods for treating a calcium carbonate-comprising material with these hydrophobising agents are described, for example, in EP 2 722 368 A1 and EP 2 770 017 A1.

According to one embodiment, the salifiable alkaline or alkaline earth compound is in form of particles having a weight median particle size $d_{50}$ from 15 nm to 200 μm, preferably from 20 nm to 100 μm, more preferably from 50 nm to 50 μm, and most preferably from 100 nm to 2 μm.

According to one embodiment, the salifiable alkaline or alkaline earth compound has a specific surface area (BET) from 4 to 120 $m^2/g$, preferably from 8 to 50 $m^2/g$, as measured using nitrogen adsorption in the BET method, according to ISO 9277.

According to one embodiment, the thermochromic coating layer further comprises a binder, preferably in an amount from 1 to 50 wt.-%, based on the total weight of the thermochromic coating layer, preferably in an amount from 3 to 30 wt.-%, and more preferably from 5 to 15 wt.-%.

Any binder suitable for thermochromic coating layers may be used. For example, the binder may be a hydrophilic polymer such as, for example, polyvinyl alcohol, polyvinyl pyrrolidone, gelatin, cellulose ethers, polyoxazolines, polyvinylacetamides, partially hydrolyzed polyvinyl acetate/vinyl alcohol, polyacrylic acid, polyacrylamide, polyalkylene oxide, sulfonated or phosphated polyesters and polystyrenes, casein, zein, albumin, chitin, chitosan, dextran, pectin, collagen derivatives, collodian, agar-agar, arrowroot, guar, carrageenan, starch, tragacanth, xanthan, or rhamsan and mixtures thereof. It is also possible to use other binders such as hydrophobic materials, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like and mixtures thereof. Further examples of suitable binders are homopolymers or copolymers of acrylic and/or methacrylic acids, itaconic acid, and acid esters, such as e.g. ethylacrylate, butyl acrylate, styrene, unsubstituted or substituted vinyl chloride, vinyl acetate, ethylene, butadiene, acrylamides and acrylonitriles, silicone resins, water dilutable alkyd resins, acrylic/alkyd resin combinations, natural oils such as linseed oil, and mixtures thereof.

The thermochromic coating layer may also comprise a sensitizer, preferably in an amount from 1 to 30 wt.-%, based on the total weight of the thermochromic coating layer, more preferably in an amount from 3 to 20 wt.-%, and most preferably from 5 to 15 wt.-%. Sensitizers usually have a melting point, which is lower than that of the leuco dye and the colour developing agent. Typically the melting point of sensitizers is between 45 and 65° C. Thus, the sensitizer can act as a solvent, promoting the interaction of the colour developing agent with the leuco dye.

All sensitizers well known in the art may be used in the thermochromic coating layer of the present invention. Examples of suitable sensitizers are, aliphatic acid amides such as ethylene bis-amide, montan acid wax, polyethylene wax, 1,4-diethoxy-naphthalene, 1-hydroxy-2-naphthoic acid phenyl ester, o-xylene-bis-(phenyl ether), 4-(m-methyl phenoxymethyl) biphenyl, 4,4'-ethylene dioxy-bis-benzoic acid dibenzyl ester, dibenzoyloxy methane, 1,2-di(3-methylphenoxy) ethylene, bis[2-(4-methoxy-phenoxy) ethyl]ether, methyl p-nitrobenzoate, phenyl p-toluene sulfonate, stearic acid amide, palmitic acid amide, methoxycarbonyl-N-benzamidestearate, N-benzoylstearic acid amide, N-eicosenoic acid amide, ethylene-bis-stearic acid amide, behenic acid amide, methylene-bis-stearic acid amide, methylolamide, N-methylol-stearic acid amide, dibenzyl terephthalate, dimethyl terephthalate, dioctyl terephthalate, p-benzyloxybenzyl-benzoate, 1-hydroxy-2-phenylnaphthoate, dibenzyloxalate di-p-methylbenzyloxalate, di-p-chlorobenzyloxalate, 2-naphthyl-benzylether, m-terphenyl, p-benzylbiphenyl, 4-biphenyl-p-tolylether, di(p-methoxy-phenoxyethyl)ether, 1,2-di(3-methylphenoxy)-ethane, 1,2-di(4-methylphenoxy)-ethane, 1,2-di(4-methoxyphenoxy)ethane, 1,2-di(4-chlorophenoxy)ethane, 1,2-di-phenoxyethane, 1-(4-methoxyphenoxy)-2-(2-methyl-phenoxy)ethane, p-methylthiophenylbenzylether, 1,4-di(phenylthio)buthane, p-acetotoluidide, p-aceto-phenetidide, N-acetoacetyl-p-toluidine, di-(β-biphenylethoxy)-benzene, p-di-(vinyloxyethoxy)benzene, 1-isopropylphenyl-2-phenylethane, 1,2-bis-(phenoxymethyl)benzene, p-toluenesulfonamide, o-toluenesulfonamide, di-p-tolyl-carbonate, phenyl-α-naphtylcarbonate, 4-(4-tolyloxy)biphenyl, 1,1'-sulphonyl bis-benzene, and mixtures thereof.

Other optional additives that may be present in the thermochromic coating layer are, for example, dispersants, milling aids, surfactants, rheology modifiers, lubricants, defoamers, optical brighteners, dyes, preservatives, or pH controlling agents.

According to one embodiment, the thermochromic coating layer further comprises a rheology modifier. Preferably the rheology modifier is present in an amount of less than 1 wt.-%, based on the total weight of the filler.

According to one embodiment, the thermochromic coating layer has a coat weight from 0.5 to 100 $g/m^2$, preferably from 1 to 75 $g/m^2$, more preferably from 2 to 50 $g/m^2$, and most preferably from 4 to 25 $g/m^2$.

The thermochromic coating layer may have a thickness of at least 1 am, e.g. at least am, 10 am, 15 am or 20 am. Preferably, the thermochromic coating layer may have a thickness in the range of 1 am up to 150 am.

The thermochromic coating layer may be in direct contact with the surface of the substrate. In case the substrate already comprises one or more precoating layers and/or barrier layers, the coating layer may be in direct contact with the top precoating layer or barrier layer, respectively.

According to one embodiment, the thermochromic coating layer is in direct contact with the surface of the substrate.

According to another embodiment, the substrate comprises one or more additional precoating layers between the substrate and the thermochromic coating layer comprising at least one halochromic leuco dye. Such additional precoating layers may comprise kaolin, silica, talc, plastic, precipitated calcium carbonate, modified calcium carbonate, ground calcium carbonate, or mixtures thereof. In this case, the thermochromic coating layer may be in direct contact with the precoating layer, or, if more than one precoating layer is present, the thermochromic coating layer may be in direct contact with the top precoating layer.

According to another embodiment of the present invention, the substrate comprises one or more barrier layers between the substrate and the thermochromic coating layer comprising at least one halochromic leuco dye. In this case, the thermochromic coating layer may be in direct contact with the barrier layer, or, if more than one barrier layer is present, the thermochromic coating layer may be in direct contact with the top barrier layer. The barrier layer may comprise a polymer, for example, polyvinyl alcohol, polyvinyl pyrrolidone, gelatin, cellulose ethers, polyoxazolines, polyvinylacetamides, partially hydrolyzed polyvinyl acetate/vinyl alcohol, polyacrylic acid, polyacrylamide, polyalkylene oxide, sulfonated or phosphated polyesters and polystyrenes, casein, zein, albumin, chitin, chitosan, dextran, pectin, collagen derivatives, collodian, agar-agar, arrowroot, guar, carrageenan, starch, tragacanth, xanthan, rhamsan, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like and mixtures thereof. Further examples of suitable barrier layers are homopolymers or copolymers of acrylic and/or methacrylic acids, itaconic acid, and acid esters, such as e.g. ethylacrylate, butyl acrylate, styrene, unsubstituted or substituted vinyl chloride, vinyl acetate, ethylene, butadiene, acrylamides and acrylonitriles, silicone resins, water dilutable alkyd resins, acrylic/alkyd resin combinations, natural oils such as linseed oil, and mixtures thereof. According to one embodiment, the barrier layer comprises latexes, polyolefins, polyvinylalcohols, kaolin, talcum, mica for creating tortuous structures (stacked structures), and mixtures thereof.

According to still another embodiment of the present invention, the substrate comprises one or more precoating and barrier layers between the substrate and the thermochromic coating layer comprising at least one halochromic leuco dye. In this case, the thermochromic coating layer may be in direct contact with the top precoating layer or barrier layer, respectively.

According to one embodiment, the substrate comprises a first side and a reverse side, and the substrate comprises a thermochromic coating layer comprising at least one halochromic leuco dye on the first side and the reverse side.

According to one embodiment of the present invention, the substrate of step a) is prepared by i) providing a substrate, ii) applying a thermochromic coating composition comprising at least one halochromic leuco dye on at least one side of the substrate to form a thermochromic coating layer, and iii) optionally, drying the thermochromic coating layer.

The thermochromic coating composition can be in liquid or dry form. According to one embodiment, the thermochromic coating composition is a dry coating composition. According to another embodiment, the thermochromic coating composition is a liquid coating composition. In this case, the thermochromic coating layer may be dried.

According to one embodiment of the present invention, the thermochromic coating composition is an aqueous composition, i.e. a composition containing water as the only solvent. According to another embodiment, the thermochromic coating composition is a non-aqueous composition. Suitable solvents are known to the skilled person and are, for example, aliphatic alcohols, ethers and diethers having from 4 to 14 carbon atoms, glycols, alkoxylated glycols, glycol ethers, alkoxylated aromatic alcohols, aromatic alcohols, mixtures thereof, or mixtures thereof with water.

According to one embodiment of the present invention, the solids content of the thermochromic coating composition is in the range from 5 wt.-% to 75 wt.-%, preferably from 20 to 67 wt.-%, more preferably from 30 to 65 wt.-%, and most preferably from 50 to 62 wt.-%, based on the total weight of the composition. According to a preferred embodiment, the thermochromic coating composition is an aqueous composition having a solids content in the range from 5 wt.-% to 75 wt.-%, preferably from 20 to 67 wt.-%, more preferably from 30 to 65 wt.-%, and most preferably from 50 to 62 wt.-%, based on the total weight of the composition.

According to one embodiment of the present invention, the thermochromic coating composition has a Brookfield viscosity of between 10 and 4000 mPa·s at 20° C., preferably between 100 and 3500 mPa·s at 20° C., more preferably between 200 and 3000 mPa·s at 20° C., and most preferably between 250 and 2000 mPa·s at 20° C.

According to one embodiment, method steps ii) and iii) are also carried out on the reverse side of the substrate to manufacture a substrate being coated on the first and the reverse side. These steps may be carried out for each side separately or may be carried out on the first and the reverse side simultaneously.

According to one embodiment of the present invention, method steps ii) and iii) are carried out two or more times using a different or the same thermochromic coating composition.

According to one embodiment of the present invention, one or more additional coating compositions are applied onto at least one side of the substrate before method step ii). The additional coating compositions may be precoating compositions and/or a barrier layer compositions.

The coating compositions may be applied onto the substrate by conventional coating means commonly used in this art. Suitable coating methods are, e.g., air knife coating, electrostatic coating, metering size press, film coating, spray coating, wound wire rod coating, slot coating, slide hopper coating, gravure, curtain coating, high speed coating and the like. Some of these methods allow for simultaneous coatings of two or more layers, which is preferred from a manufacturing economic perspective. However, any other coating method which would be suitable to form a coating layer on the substrate may also be used. According to an exemplary embodiment, the coating composition is applied by high speed coating, metering size press, curtain coating, spray coating, flexo and gravure, or blade coating, preferably curtain coating.

According to step iii), the thermochromic coating layer formed on the substrate is dried. The drying can be carried out by any method known in the art, and the skilled person will adapt the drying conditions such as the temperature according to his process equipment and the thermochromic coating layer components, e.g. the halochromic leuco dye, the colour developing agent, or sensitizer, if present.

Method Step b)

According to step b) of the method of the present invention, a liquid treatment composition comprising at least one acid is provided.

The liquid treatment composition may comprise any suitable inorganic or organic acid. According to one embodiment, the at least one acid is an organic acid, preferably a monocarboxylic, dicarboxylic or tricarboxylic acid.

According to one embodiment, the at least one acid is a strong acid having a $pK_a$ of 0 or less at 20° C. According to another embodiment, the at least one acid is a medium-strong acid having a $pK_a$ value from 0 to 2.5 at 20° C. If the $pK_a$ at 20° C. is 0 or less, the acid is preferably selected from sulphuric acid, hydrochloric acid, or mixtures thereof. If the $pK_a$ at 20° C. is from 0 to 2.5, the acid is preferably selected from $H_2SO_3$, $H_3PO_4$, oxalic acid, or mixtures thereof. However, acids having a $pK_a$ of more than 2.5 may also be used, for example, suberic acid, succinic acid, acetic acid, citric acid, formic acid, sulphamic acid, tartaric acid, benzoic acid, or phytic acid.

The at least one acid can also be an acidic salt, for example, $HSO_4^-$, $H_2PO_4^-$ or $HPO_4^{2-}$, being at least partially neutralized by a corresponding cation such as $Li^+$, $Na^+$, $K^+$, $Mg^{2+}$ or $Ca^{2+}$. The at least one acid can also be a mixture of one or more acids and one or more acidic salts.

According to one embodiment of the present invention, the at least one acid is selected from the group consisting of hydrochloric acid, sulphuric acid, sulphurous acid, phosphoric acid, citric acid, oxalic acid, acetic acid, formic acid, sulphamic acid, tartaric acid, phytic acid, boric acid, succinic acid, suberic acid, benzoic acid, adipic acid, pimelic acid, azelaic acid, sebaic acid, isocitric acid, aconitic acid, propane-1,2,3-tricarboxylic acid, trimesic acid, glycolic acid, lactic acid, mandelic acid, acidic organosulphur compounds, acidic organophosphorus compounds, $HSO_4^-$, $H_2PO_4^-$ or $HPO_4^{2-}$, being at least partially neutralized by a corresponding cation selected from $Li^+$, $Na^+$ $K^+$, $Mg^{2+}$ or $Ca^{2+}$, and mixtures thereof. According to a preferred embodiment, the at least one acid is selected from the group consisting of hydrochloric acid, sulphuric acid, sulphurous acid, phosphoric acid, oxalic acid, boric acid, suberic acid, succinic acid, sulphamic acid, tartaric acid, and mixtures thereof, more preferably the at least one acid is selected from the group consisting of sulphuric acid, phosphoric acid, boric acid, suberic acid, sulphamic acid, tartaric acid, and mixtures thereof, and most preferably the at least one acid is phosphoric acid and/or sulphuric acid.

Acidic organosulphur compounds may be selected from sulphonic acids such as Nafion, p-toluenesulphonic acid, methanesulphonic acid, thiocarboxylic acids, sulphinic acids and/or sulphenic acids. Examples for acidic organophosphorus compounds are aminomethylphosphonic acid, 1-hydroxyethylidene-1,1-diphosphonic acid (HEDP), amino tris (methylenephosphonic acid) (ATMP), ethylenediamine tetra (methylene phosphonic acid) (EDTMP), tetramethylenediamine tetra(methylene phosphonic acid) (TDTMP), hexamethylenediamine tetra(methylene phosphonic acid) (HDTMP), diethylenetriamine penta(methylene phosphonic acid) (DTPMP), phosphonobutane-tricarboxylic acid (PBTC), N-(phosphonomethyl)-iminodiacetic acid (PMIDA), 2-carboxyethyl phosphonic acid (CEPA), 2-hydroxy-phosphonocarboxylic acid (HPAA), Amino-tris-(methylene-phosphonic acid), or di-(2-ethylhexyl)phosphoric acid.

The at least one acid may consist of only one type of acid. Alternatively, the at least one acid can consists of two or more types of acids.

The at least one acid may be applied in concentrated form or in diluted form. According to one embodiment of the present invention, the liquid treatment composition comprises at least one acid and water. According to another embodiment of the present invention, the liquid treatment composition comprises at least one acid and a solvent. According to another embodiment of the present invention, the liquid treatment composition comprises at least one acid, water, and a solvent. Suitable solvents are known in the art and are, for example, aliphatic alcohols, ethers and diethers having from 4 to 14 carbon atoms, glycols, alkoxylated glycols, glycol ethers, alkoxylated aromatic alcohols, aromatic alcohols, mixtures thereof, or mixtures thereof with water.

According to one exemplary embodiment, the liquid treatment composition comprises phosphoric acid, ethanol, and water, preferably the liquid treatment composition comprises 30 to 50 wt.-% phosphoric acid, 10 to 30 wt.-% ethanol, and 20 to 40 wt.-% water, based on the total weight of the liquid treatment composition. According to another exemplary embodiment, the liquid treatment composition comprises 20 to 40 vol.-% phosphoric acid, 20 to 40 vol.-% ethanol, and 20 to 40 vol.-% water, based on the total volume of the liquid treatment composition.

According to one exemplary embodiment, the liquid treatment composition comprises sulphuric acid, ethanol, and water, preferably the liquid treatment composition comprises 1 to 10 wt.-% sulphuric acid, 10 to 30 wt.-% ethanol, and 70 to 90 wt.-% water, based on the total weight of the liquid treatment composition. According to another exemplary embodiment, the liquid treatment composition comprises 10 to 30 vol.-% sulphuric acid, 10 to 30 vol.-% ethanol, and 50 to 80 vol.-% water, based on the total volume of the liquid treatment composition.

According to one embodiment, the liquid treatment composition comprises the at least one acid in an amount from 0.1 to 100 wt.-%, based on the total weight of the liquid treatment composition, preferably in an amount from 1 to 80 wt.-%, more preferably in an amount from 3 to 60 wt.-%, and most preferably in an amount from 10 to 50 wt.-%.

In addition to the at least one acid, the liquid treatment composition may further comprise a dye, a pigment, a fluorescent dye, a phosphorescent dye, an ultraviolet absorbing dye, a near infrared absorbing dye, a thermochromic dye, a halochromic dye, metal ions, transition metal ions, lanthanides, actinides, magnetic particles, quantum dots or a mixture thereof. Such additional compounds can equip the substrate with additional features, such as specific light absorbing properties, electromagnetic radiation reflection properties, fluorescence properties, phosphorescence properties, magnetic properties, or electric conductivity.

According to one embodiment, the liquid treatment composition further comprises a dye. According to another embodiment, the liquid treatment composition further comprises a dye and an ultraviolet absorbing dye and/or a near infrared absorbing dye.

According to a preferred embodiment, the liquid treatment composition comprises a dye, and most preferably a solvent-soluble dye. It will be appreciated by the skilled person that in case the liquid treatment composition comprises a solvent-soluble dye, a solvent has to be added to the liquid treatment composition in order to dissolute the solvent-soluble dye. For example, aliphatic alcohols such as ethanol may be included. Examples of other suitable solvents are mentioned above.

Method Step c)

According to method step c), the liquid treatment composition is applied onto the at least one region of the thermochromic coating layer in form of a preselected pattern. Thereby, a tamper-proof pattern is formed on and/or within the thermochromic coating layer.

The liquid treatment composition can be applied onto at least one region of the thermochromic coating layer by any suitable method known in the art.

According to one embodiment, the liquid treatment composition is applied by spray coating, inkjet printing, offset printing, flexographic printing, screen printing, plotting, contact stamping, rotogravure printing, spin coating, slot coating, curtain coating, slide bed coating, film press, metered film press, blade coating, brush coating, stamping and/or a pencil. According to a preferred embodiment the liquid treatment composition is applied by inkjet printing, for example, by continuous inkjet printing, intermitting inkjet printing or drop-on-demand inkjet printing.

The inkjet printing technology may provide the possibility to place very small droplets onto the thermochromic coating layer, which allows to form high resolution patterns on and/or within the thermochromic coating layer. According to one embodiment, the liquid treatment composition is applied to the thermochromic coating layer in form of droplets. Depending on the inkjet printer, the droplets may have a volume in the range from 10 μl to 0.5 pl, wherein "pl" means "picoliter". According to one embodiment, the droplets have a volume of less than or equal to 10 μl, preferably less than or equal to 100 nl, more preferably less than or equal to 1 nl, even more preferably less than or equal to 10 pl, and most preferably less than or equal to 0.5 pl. For example, the droplets may have a volume from 10 μl to 1 μl, from 1 μl to 100 nl, from 100 nl to 10 nl, from 10 nl to 1 nl, from 1 nl to 100 pl, from 100 pl to 10 pl, from 10 pl to 1 pl, or of about 0.5 pl.

According to another embodiment, the liquid treatment composition is applied to the thermochromic coating layer in form of droplets to form surface-modified pixels on and/or within the thermochromic coating layer. The pixels may have a diameter of less than 5 mm, preferably less 1000 μm, more preferably less than 200 μm, and most preferably less than 100 μm, or even less than 10 μm.

The application of the liquid treatment composition onto the thermochromic coating layer can be carried out at a surface temperature of the substrate, which is at room temperature, i.e. at a temperature of 20±2° C., or at an elevated temperature, which is below the temperature at which the colour is developed within the thermochromic coating layer, for example, at about 40° C. Carrying out method step b) at an elevated temperature may enhance the drying of the liquid treatment composition, and, hence, may reduce production time.

According to the method of the present invention, the liquid treatment composition is applied onto at least one region of the thermochromic coating layer in form of a preselected pattern. The preselected pattern may be a continuous layer, a pattern, a pattern of repetitive elements and/or a repetitive combination(s) of elements.

According to one embodiment, the liquid treatment composition is applied to the substrate in form of a pattern of repetitive elements or repetitive combination(s) of elements, preferably selected from the group consisting of circles, dots, triangles, rectangles, squares, or lines.

According to a preferred embodiment, the preselected pattern is a guilloche, a one-dimensional bar code, a two-dimensional bar code, a three-dimensional bar code, a QR-code, a dot matrix code, a security mark, a number, a letter, an alphanumeric symbol, a logo, an image, a shape, a signature, a design, or a combination thereof. The pattern may have a resolution of more than 10 dpi, preferably more than 50 dpi, more preferably more than 100 dpi, even more preferably more than 1000 dpi, and most preferably more than 10000 dpi, wherein dpi means dots per inch.

Without being bound to any theory, it is believed that by the application of the liquid treatment composition onto at least one region of the thermochromic coating layer, the at least one halochromic leuco dye reacts with the acid included in the treatment composition. The inventors surprisingly found that in the regions of the thermochromic coating layer, which were treated with the liquid treatment composition, the halochromic leuco dye was converted into its coloured form. In other words, it was found that a coloured pattern can be directly produced on a medium for thermal printing by applying the liquid treatment composition of the present invention.

Furthermore, the method of the present invention has the advantage that it can be implemented in existing thermal printing media production facilities and does not require cost-intensive and time-consuming modifications. For example, the method of the present invention may be implemented into an existing thermal paper production facility by applying a preselected pattern to the thermal paper using a conventional inkjet printer, wherein the liquid treatment composition of the present invention is used as ink.

It was also found that in case the thermochromic coating layer comprises a salifiable alkaline or alkaline earth compound as filler, the salifiable alkaline or alkaline earth compound is at least partially converted into a corresponding acid salt, which has a different chemical composition and crystal structure compared to the original material. In case the salifiable alkaline or alkaline earth compound is an alkaline or alkaline earth carbonate, for example, the compound would be converted by the acid treatment into a non-carbonate alkaline or alkaline earth salt of the applied acid. According to one embodiment of the present invention, the thermochromic coating layer comprises calcium carbonate, and the liquid treatment composition comprises phosphoric acid, and the obtained pattern comprises a water-insoluble calcium phosphate salt, for example, hydroxyapatite, calcium hydrogen phosphate hydrate, calcium phosphate, brushite, and combinations thereof, preferably calcium phosphate and/or brushite. According to another embodiment of the present invention, the thermochromic coating layer comprises calcium carbonate and the liquid treatment composition comprises sulphuric acid, and the obtained pattern comprises gypsum.

According to one embodiment, the method of manufacturing a tamper-proof medium for thermal printing comprises the following steps:

a) providing a substrate, wherein the substrate comprises on at least one side a thermochromic coating layer comprising at least one halochromic leuco dye, wherein the substrate is selected from the group consisting of paper, cardboard, containerboard, and plastic, selected from the group consisting of paper, cardboard, and containerboard, wherein the at least one halochromic leuco dye is selected from the group consisting of arylmethane phthalide dyes, quinone dyes, triarylmethane dyes, triphenylmethane dyes, fluoran dyes, phenothiazine dyes, rhodamine lactam dyes, spiropyran dyes, and mixtures thereof, and wherein the thermochromic coating layer further comprises a colour developing agent, b) providing a liquid treatment composition comprising at least one acid, wherein the at least one acid is selected from the group consisting of sulphuric acid, phosphoric acid, boric acid, suberic acid, sulphamic acid, tartaric acid, and mixtures thereof, and preferably the at least one acid is phosphoric acid, and c) applying the liquid treatment composition onto at least one region of the thermochromic coating layer in form of a preselected pattern. In addition, the substrate may comprise a salifiable alkaline or alkaline earth compound and/or a the liquid treatment composition may further comprise a dye.

Additional Process Steps

According to one embodiment of the invention, the method further comprises a step d) of applying a protective layer above the thermochromic coating layer.

The protective layer can be made from any material, which is suitable to protect the underlying pattern against unwanted environmental impacts or mechanical wear. Examples for suitable materials are top coats, resins, varnishes, silicones, polymers, metal foils, or cellulose-based materials.

The protective layer may be applied above the thermochromic coating layer by any method known in the art and suitable for the material of the protective layer. Suitable methods are, for example, air knife coating, electrostatic coating, metering size press, film coating, spray coating, extrusion coating, wound wire rod coating, slot coating, slide hopper coating, gravure, curtain coating, high speed coating, lamination, printing, adhesive bonding, and the like.

According to one embodiment, the protective layer is a removable protective layer.

According to a further embodiment of the present invention, the substrate provided in step a) comprises a thermochromic coating layer comprising at least one halochromic leuco dye on the first side and a reverse side of the substrate, and in step c) the liquid treatment composition comprising at least one acid is applied onto the first and the reverse side in form of a preselected pattern. Step c) may be carried out for each side separately or may be carried out on the first and the reverse side simultaneously.

According to one embodiment of the present invention, method step c) is carried out two or more times using a different or the same liquid treatment composition. Thereby, different patterns with different properties can be created.

The Tamper-Proof Medium for Thermal Printing

According to one aspect of the present invention, a tamper-proof medium for thermal printing is provided, obtainable by a method comprising the following steps:

a) providing a substrate, wherein the substrate comprises on at least one side a thermochromic coating layer comprising at least one halochromic leuco dye,
b) providing a liquid treatment composition comprising at least one acid, and
c) applying the liquid treatment composition onto at least one region of the thermochromic coating layer in form of a preselected pattern.

The inventors surprisingly found that by the inventive method a coloured pattern can be directly produced on a medium for thermal printing. This provides, for example, the possibility to create a security mark in form of a complex pattern on and/or within the thermochromic coating layer of a thermal printing medium. The thermal printability of the medium, however, is not impaired. Thus, the tamper-proof thermal printing medium of the present invention still can be printed with a conventional thermal printer. If a fraudster tries to manipulate a thermal print made on such a thermochromic coating layer, for example, by erasing the same with an alkaline solution, the complex pattern would be removed as well. However, reprinting a complex pattern such as a guilloche would be very challenging, if not impossible.

Furthermore, it was found that the at least one halochromic leuco dye can be triggered to different contrasts by applying different liquid treatment compositions or using different application settings. Such a pattern would be even more difficult to restore or to fake.

Moreover, the present invention provides the possibility to equip the thermal printing medium with additional functionalities by adding further components to the liquid treatment composition. For example, the liquid treatment composition can comprise an additional colorant, which is not halochromic, and thus, remains after removing the genuine thermal print. It would also be possible to render the pattern UV-detectable by adding an UV or IR absorbing dye to the liquid treatment composition or to make it machine readable by adding magnetic or electrically conductive particles. It would also be possible to combine the additional colorant with an UV or IR absorbing dye.

It was also found that in case the thermochromic coating layer comprises a salifiable alkaline or alkaline earth compound as filler, a surface-modified structure can be created on and/or within in the thermochromic coating layer, which has a different chemical composition and crystal structure compared to the original material. The formed pattern can differ from the untreated thermochromic coating layer in tactility, surface roughness, gloss, light absorption, electromagnetic radiation reflection, fluorescence, phosphorescence, whiteness and/or brightness. These additional distinguishable properties can be utilized to detect the pattern visually, tactilely, or at alternative conditions, for example, under UV light, near infrared light or X-ray diffraction using an appropriate detector.

A further advantage is that the method of the present invention provides the possibility to equip a medium for thermal printing with a multilayer protection against counterfeiting by combining several security features in only one production step. For example, a printed feature which is visually detectable such as a printed guilloche can be combined with a hidden feature, which can be part of the printed feature, the substrate and/or thermochromic coating layer and which can only be detected using special equipment such as a UV- and/or infrared detectable feature. The hidden feature may also be a forensically detectable feature such as specific surface modification on or within the thermochromic coating layer. It is also possible to equip the inventive tamper-proof medium for thermal printing with other security features such as optically varying features, embossing, watermarks, threads, or holograms.

The tamper-proof medium for thermal printing according to the present invention is suitable for a wide range of applications. The skilled person will appropriately select the type of substrate for the desired application.

According to one embodiment the tamper-proof medium for thermal printing according to the present invention is used in security applications, in overt security elements, in covert security elements, in brand protection, in deviation prevention, in microlettering, in micro imaging, in decorative applications, in artistic applications, in visual applications, in packaging applications, in printing applications, in monitoring applications, or in track and trace applications.

According to one embodiment the tamper-proof medium is a branded product, a security document, a non-secure document, or a decorative product, preferably the product is a packaging, a container, a compact disc (CD), a digital video disc (DVD), a blue ray disc, a sticker, a label, a seal, a tag, a poster, a passport, a driving licence, a bank card, a credit card, a bond, a ticket, a postage stamp, tax stamp, a banknote, a certificate, a brand authentication tag, a business card, a greeting card, a voucher, a tax banderol, a point-of-sale receipt, a plot, a fax, a continuous recording sheet or reel, or a wall paper.

The scope and interest of the present invention will be better understood based on the following figures and examples which are intended to illustrate certain embodiments of the present invention and are non-limitative.

EXAMPLES

In the following, measurement methods implemented in the examples are described.

1. Methods and Materials

Photographs

Images of the prepared samples were recorded with the document detector PF-3000 (Ribao Technology, China).

Substrates

S1: Ticket of Münchner Verkehrs-und Tarifverbund (MVV), commercially bought from ticket machine in Munich, Germany.

S2: Ticket of Deutsche Bahn AG (DB), commercially bought from ticket machine in Stuttgart, Germany.

S3: Ticket of Schweizerische Bundesbahnen (SBB), commercially bought from ticket machine in Oftringen, Switzerland. The thermochromic coating layer of the ticket paper includes calcium carbonate as filler.

Liquid Treatment Composition

L1: 41 wt.-% phosphoric acid, 24 wt.-% ethanol, and 35 wt.-% water (wt.-% are based on the total weight of the liquid treatment composition).

L2: 41 wt.-% phosphoric acid, 24 wt.-% ethanol, 34 wt.-% water, and 1 wt.-% Amaranth red (wt.-% are based on the total weight of the liquid treatment composition).

Erasing Liquid

Potassium hydroxide solution (1.0 M).

2. Examples

Tamper-proof tickets were prepared by applying the liquid treatment composition onto the above-mentioned substrates in form of a preselected pattern (guilloche or logo "mosaiq") with an inkjet printer (Dimatix DMP 2800, Fujifilm Dimatix Inc., USA) with varying droplet sizes between 1 and 10 pl (pico litre) at varying drop spacings between 10 to 40 am.

Example 1—Guilloche Pattern with Different Colour Intensities

Guilloche patterns were printed on substrate S1 with different amounts of liquid treatment composition L1, wherein the amount was controlled by varying the droplet size and drop spacing:

TABLE 1

Printing conditions and colour of printed guilloche pattern.

| Sample | Droplet size [pl] | Drop spacing [μm] | Colour of pattern |
|---|---|---|---|
| 1 | 10 | 30 | black colour |
| 2 | 1 | 30 | grey colour |
| 3 | 1 | 40 | pale grey colour |

Figure 1:
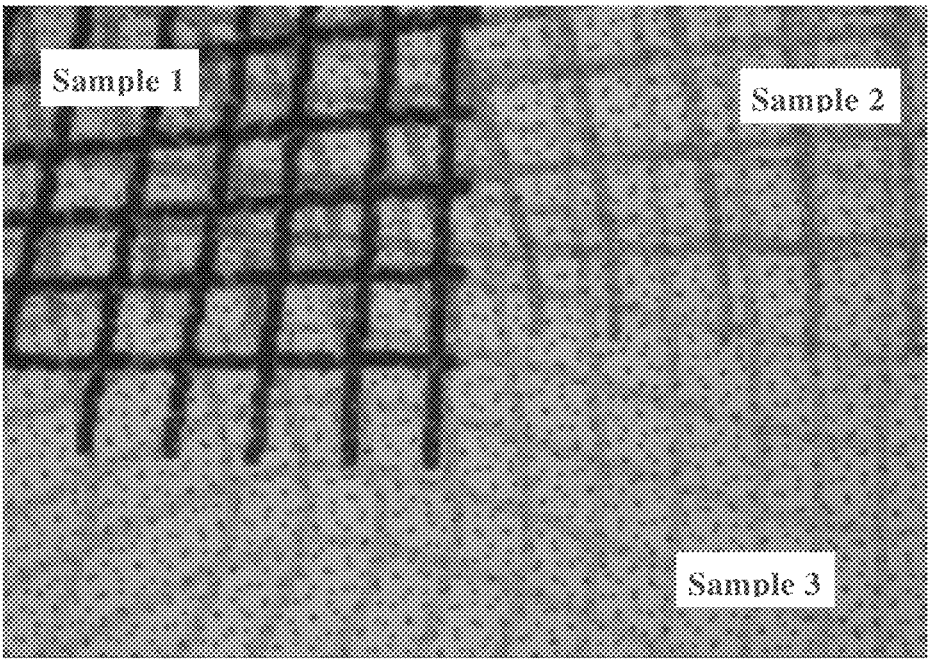
FIG. 1 shows magnifications of the substrates manufactured according to Example 1.

Magnifications of the different printed guilloche patterns are shown in FIG. 1. It is clearly visible from said figure that by the inventive method a coloured pattern can be formed on the thermochromic coating layer of a substrate. Furthermore, the colour intensity can be controlled by adjusting the droplet size and drop spacing.

Example 2—Erasing of Guilloche Pattern

A guilloche pattern was printed on substrate S2 with a droplet size of 1 pl and a drop spacing of 30 m using liquid treatment composition L1. An image of the printed substrate is shown in FIG. 2, wherein the guilloche pattern is clearly visible on the bottom right.

Subsequently, a part of the original thermal print within the guilloche pattern was gently wiped with a cloth soaked with the erasing liquid. Said treated area is highlighted in FIG. 2 by a dashed square. It can be gathered from FIG. 2 that said treatment resulted in an almost complete erasing of both the thermal print and the later added guilloche pattern.

Figure 2:
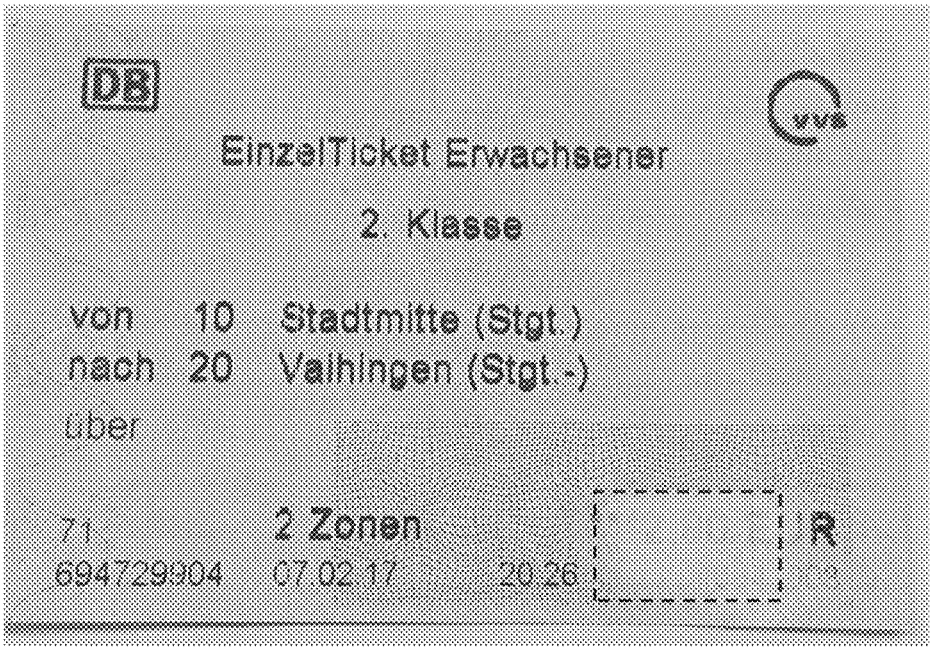
FIG. 2 shows a tamper-proof medium for thermal printing manufactured according to Example 2, wherein a part of the original print was removed by an erasing liquid.
Figure 3:
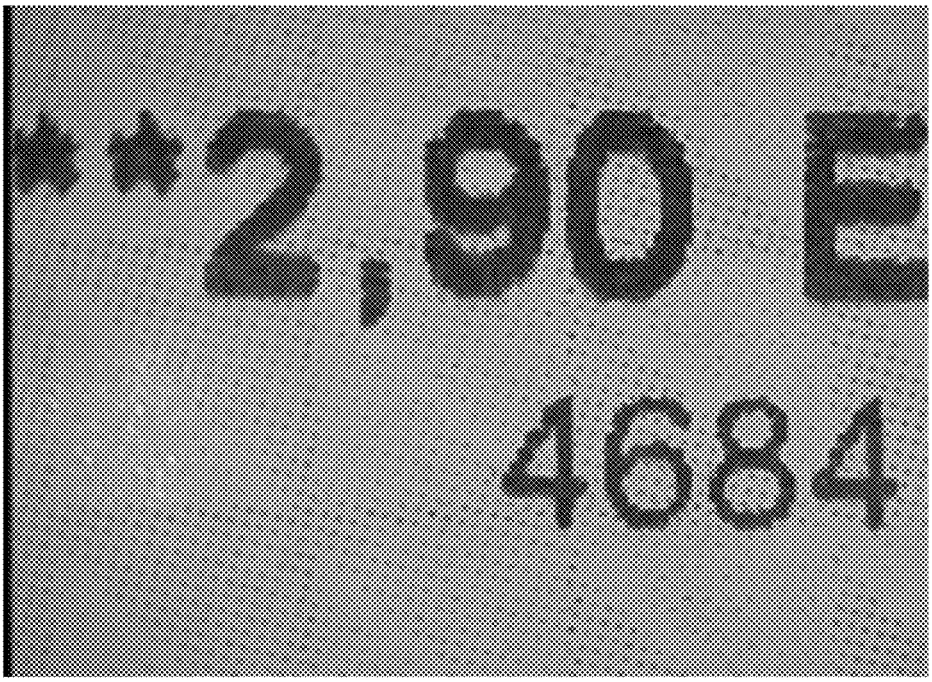
FIG. 3 shows a magnification of the section highlighted in FIG. 2 before application of the liquid treatment composition.

FIG. 3 shows a magnification of the original thermal print of substrate S2 in the section highlighted in FIG. 2 by the dashed square.

Figure 4:
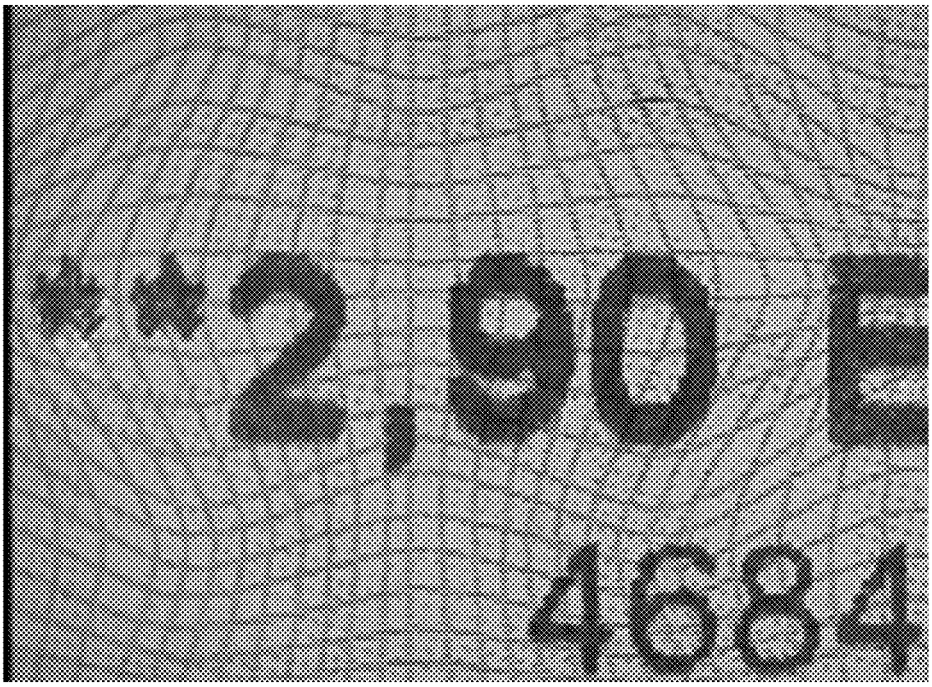
FIG. 4 shows a magnification of the section highlighted in FIG. 2 after application of the liquid treatment composition.
Figure 5:
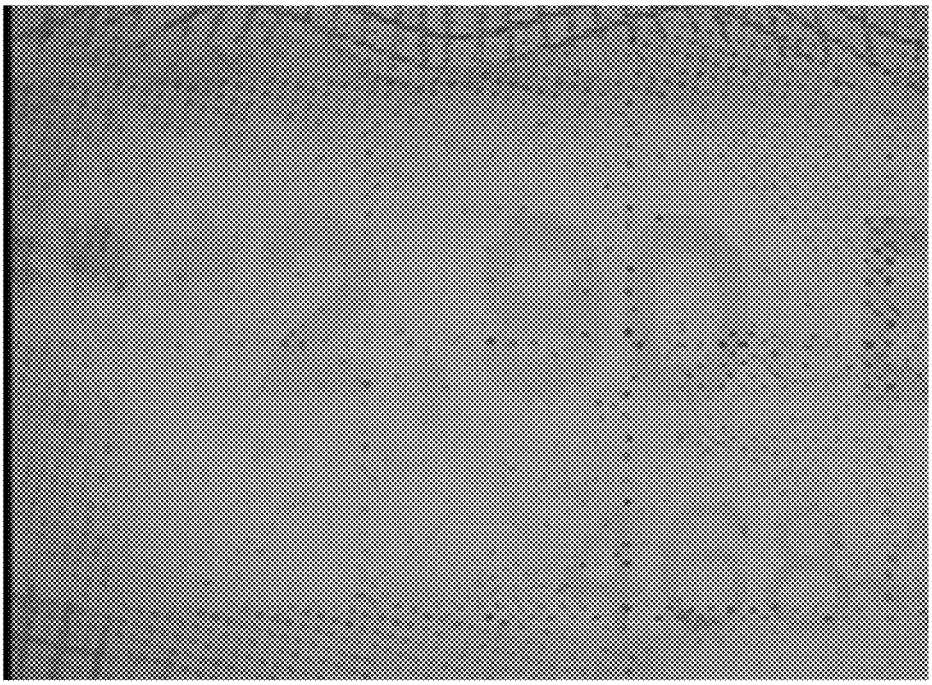
FIG. 5 shows a magnification of the section highlighted in FIG. 2 after application of the erasing liquid.
Figure 6:
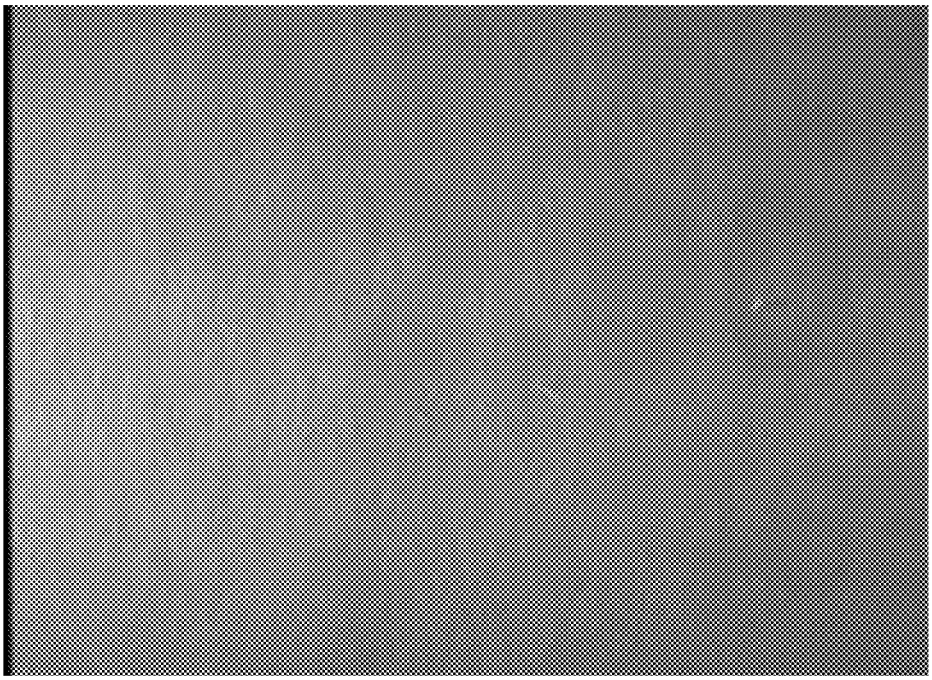
FIG. 6 shows a magnified infrared image of the section highlighted in FIG. 2 after application of the erasing liquid.

FIG. 4 shows the same section after application of the liquid treatment composition. The guilloche pattern is clearly visible. FIG. 5 shows the same spot after it has been treated with the erasing liquid. Both the thermal print and the guilloche pattern formed by the inventive method have been almost completely erased. An infrared image of the same region is shown in FIG. 6.

Thus, Example 2 confirms that by the inventive method a tamper-proof medium can be manufactured.

Example 3—Erasing of Thermal Print and Guilloche Pattern on Calcium Carbonate Containing Substrate A guilloche pattern was printed on substrate S3 with a droplet size of 1 pl and a drop spacing of 30 am using liquid treatment composition L1.

Figure 7:
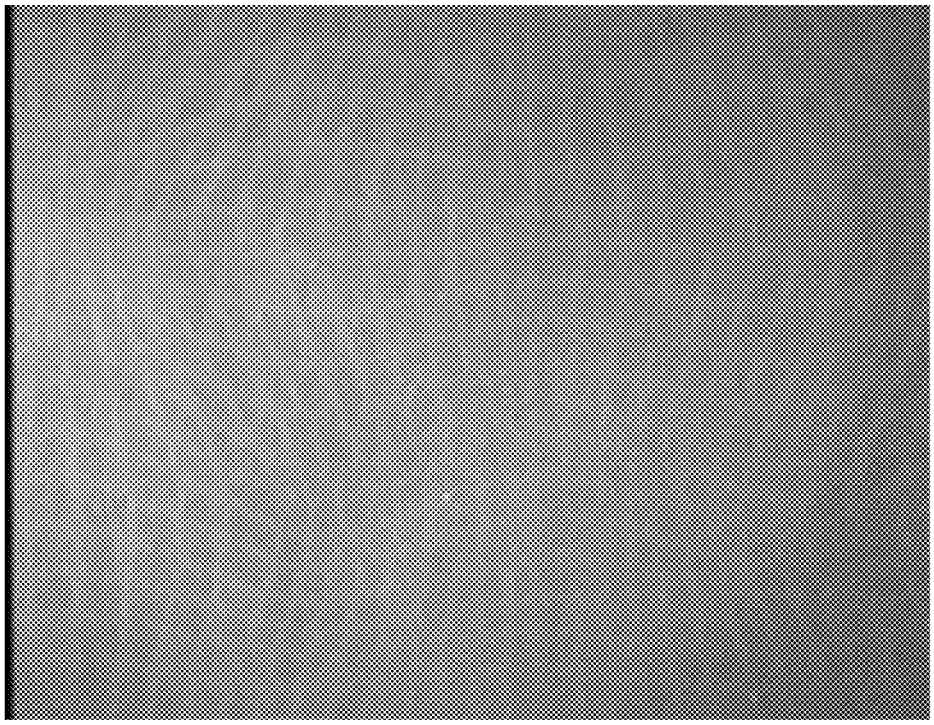
FIG. 7 shows a magnified infrared image of a tamper-proof medium for thermal printing manufactured according to Example 3, wherein the original print was removed by an erasing liquid.

Subsequently, a part of the original thermal print within the guilloche pattern was gently wiped with a cloth soaked with the erasing liquid. A magnified infrared image of treated area is shown in FIG. 7. It can be gathered from said figure that the treatment resulted in a complete erasing of both the thermal print and the later added guilloche pattern. Moreover, the application of the liquid treatment composition resulted in a build-up of a water-insoluble calcium phosphate salt, which cannot be removed.

Therefore, by including a salifiable alkaline or alkaline earth compound filler into the thermal paper, an additional security feature can be created.

Example 4—Erasing of a Thermal Print and a Logo Created by a Liquid Treatment Composition Containing a Dye A logo was printed on substrate S1 with a droplet size of 10 pl and a drop spacing of am using liquid treatment composition L1. In addition, a logo was printed on substrate S1 under the same conditions using the liquid treatment composition L2, which contains a red dye.

Figure 8:
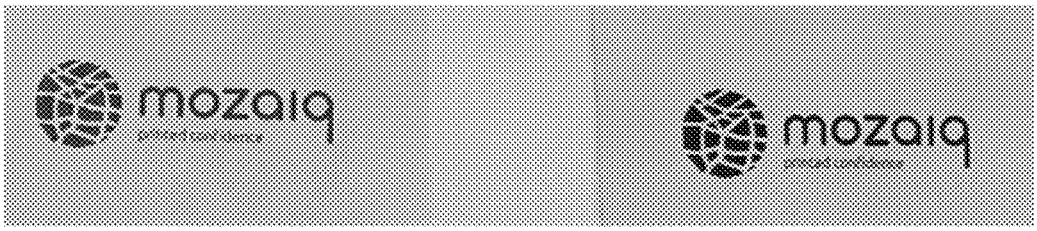
FIG. 8 shows two tamper-proof media for thermal printing manufactured according to Example 4, wherein the left logo was printed with a liquid treatment composition comprising a red dye.

Images of the printed substrates are shown in FIG. 8, wherein the logo on the right side was printed with liquid treatment composition L1 and the logo on the left side was printed with liquid treatment composition L2.

Figure 9:
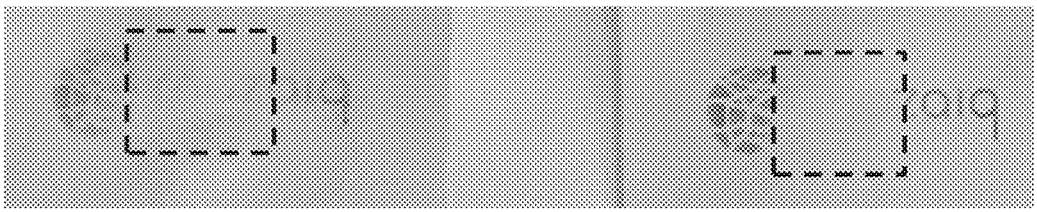
FIG. 9 shows two tamper-proof media for thermal printing manufactured according to Example 4, wherein the left logo was printed with a liquid treatment composition comprising a red dye, and wherein the logos were partially removed by an erasing liquid.

Subsequently, a part of the printed area was gently wiped with a cloth soaked with the erasing liquid. Said treated areas are highlighted in FIG. 9 by dashed squares. It can be gathered from FIG. 9 that the logo printed with liquid treatment composition L1 is almost completely erased (FIG. 9, right), while the logo printed with the liquid treatment composition L2 remains as a red print, and thus, is still visible (see FIG. 9, left).

Therefore, by including a dye into the thermal paper, an additional security feature can be created.

The invention claimed is:

1. A method of manufacturing a tamper-proof medium for thermal printing, the method comprising the following steps:

a) providing a substrate, wherein the substrate comprises on at least one side a thermochromic coating layer comprising at least one halochromic leuco dye, b) providing a liquid treatment composition comprising at least one acid, and c) applying the liquid treatment composition onto at least one region of the thermochromic coating layer in form of a preselected pattern, wherein the thermochromic coating layer further comprises a salifiable alkaline or alkaline earth compound and the salifiable alkaline or alkaline earth compound is at least partially converted into a corresponding acid salt when the liquid treatment composition is applied.

2. The method of claim 1, wherein the substrate is selected from the group consisting of paper, cardboard, containerboard, plastic, cellophane, textile, wood, metal, glass, mica plate, and nitrocellulose.

3. The method of claim 1, wherein the at least one halochromic leuco dye is colourless.

4. The method of claim 1, wherein the at least one halochromic leuco dye is selected from the group consisting of arylmethane phthalide dyes, quinone dyes, triarylmethane dyes, triphenylmethane dyes, fluoran dyes, phenothiazine dyes, rhodamine lactam dyes, spiropyran dyes, and mixtures thereof.

5. The method of claim 1, wherein the thermochromic coating layer comprises the at least one halochromic leuco dye in an amount from 1 to 60 wt.-%, based on the total weight of the thermochromic coating layer.

6. The method of claim 1, wherein the thermochromic coating layer further comprises a colour developing agent.

7. The method of claim 1, wherein the at least one acid is selected from the group consisting of hydrochloric acid, sulphuric acid, sulphurous acid, phosphoric acid, citric acid, oxalic acid, acetic acid, formic acid, sulphamic acid, tartaric acid, phytic acid, boric acid, succinic acid, suberic acid, benzoic acid, adipic acid, pimelic acid, azelaic acid, sebaic acid, isocitric acid, aconitic acid, propane-1,2,3-tricarboxylic acid, trimesic acid, glycolic acid, lactic acid, mandelic acid, acidic organosulfur compounds, acidic organophosphorus compounds, $HSO_4^-$, $H_2PO_4^-$ or $HPO_4^{2-}$, being at least partially neutralized by a corresponding cation selected from $Li^+$, $Na^+$, $K^+$, $Mg^{2+}$ or $Ca^{2+}$, and mixtures thereof.

8. The method of claim 1, wherein the liquid treatment composition further comprises a dye, a solvent-soluble dye, a pigment, a fluorescent dye, a phosphorescent dye, an ultraviolet absorbing dye, a near infrared absorbing dye, a thermochromic dye, a halochromic dye, metal ions, transition metal ions, lanthanides, actinides, magnetic particles, quantum dots, or a mixture thereof.

9. The method of claim 1, wherein the liquid treatment composition comprises the at least one acid in an amount from 0.1 to 100 wt.-%, based on the total weight of the liquid treatment composition.

10. The method of claim 1, wherein the preselected pattern is a continuous layer, a pattern, a pattern of repetitive elements, a repetitive combination(s) of elements, a guilloche, a one-dimensional bar code, a two-dimensional bar code, a three-dimensional bar code, a QR-code, a dot matrix code, a security mark, a number, a letter, an alphanumeric symbol, a logo, an image, a shape, a signature, a design, or a combination thereof.

11. The method of claim 1, wherein the liquid treatment composition is applied by spray coating, inkjet printing, offset printing, flexographic printing, screen printing, plotting, contact stamping, rotogravure printing, spin coating, slot coating, curtain coating, slide bed coating, film press, metered film press, blade coating, brush coating, stamping and/or a pencil.

12. A tamper-proof medium for thermal printing obtainable by a method according to claim 1.

13. The tamper-proof medium of claim 12, wherein the tamper-proof medium is a branded product, a security document, a non-secure document, a decorative product, a packaging, a container, a compact disc (CD), a digital video disc (DVD), a blue ray disc, a sticker, a label, a seal, a tag, a poster, a passport, a driving licence, a bank card, a credit card, a bond, a ticket, a postage stamp, tax stamp, a banknote, a certificate, a brand authentication tag, a business card, a greeting card, a voucher, a tax banderol, a point-of-sale receipt, a plot, a fax, a continuous recording sheet or reel, or a wall paper.

14. The tamper-proof medium for thermal printing according to claim 12, wherein the tamper-proof medium for thermal printing is suitable for use in security applications, in overt security elements, in covert security elements, in brand protection, in deviation prevention, in microlettering, in micro imaging, in decorative applications, in artistic applications, in visual applications, in packaging applications, in printing applications, in monitoring applications, or in track and trace applications.

15. The method of claim 1, wherein the substrate is selected from the group consisting of paper, cardboard, containerboard, and plastic.

16. The method of claim 1, wherein the thermochromic coating layer comprises the at least one halochromic leuco dye in an amount from 20 to 40 wt.-%, based on the total weight of the thermochromic coating layer.

17. The method of claim 1, wherein the thermochromic coating layer further comprises a colour developing agent in an amount from 1 to 80 wt.-%, based on the total weight of the thermochromic coating layer.

18. The method of claim 1, wherein the thermochromic coating layer further comprises a colour developing agent in an amount from 40 to 60 wt.-%, based on the total weight of the thermochromic coating layer.

19. The method of claim 1, wherein the at least one acid is phosphoric acid.

20. The method of claim 1, wherein the liquid treatment composition comprises the at least one acid in an amount from 10 to 50 wt.-%, based on the total weight of the liquid treatment composition.

21. The method of claim 1, wherein the thermochromic coating layer further comprises fillers, binders, or sensitizers.

22. The method of claim 1, wherein the salifiable alkaline or alkaline earth compound comprises calcium carbonate and the at least one acid is sulphuric acid or phosphoric acid.

23. The method of claim 1, wherein the thermochromic coating layer comprises calcium carbonate.

24. The method of claim 1, wherein the thermochromic coating layer comprises calcium carbonate and the at least one acid is selected from the group consisting of citric acid, oxalic acid, tartaric acid, and phosphoric acid.

* * * * *